US007731556B2

(12) United States Patent
Okanan et al.

(10) Patent No.: US 7,731,556 B2
(45) Date of Patent: Jun. 8, 2010

(54) FLAT PANEL DISPLAY, METHOD OF MANUFACTURING ANODE PANEL FOR THE FLAT PANEL DISPLAY, AND METHOD OF MANUFACTURING CATHODE PANEL FOR THE FLAT PANEL DISPLAY

(75) Inventors: Satoshi Okanan, Gifu (JP); Yoshimitsu Kato, Kanagawa (JP); Masaru Kokubukata, Gifu (JP); Keiji Honda, Aichi (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 11/555,932

(22) Filed: Nov. 2, 2006

(65) Prior Publication Data

US 2007/0200486 A1 Aug. 30, 2007

(30) Foreign Application Priority Data

Nov. 2, 2005 (JP) ..... P2005-319227

(51) Int. Cl.
*H01J 1/02* (2006.01)
*H01J 63/04* (2006.01)
*H01J 1/62* (2006.01)

(52) U.S. Cl. ..... 445/24; 445/25; 445/50; 313/301; 313/496; 313/498; 257/40

(58) Field of Classification Search ..... 313/293–304, 313/309, 310, 495–497; 445/24, 25
See application file for complete search history.

(56) References Cited

U.S. PATENT DOCUMENTS 6,154,188 A 11/2000 Learn et al.
6,215,077 B1 * 4/2001 Utsumi et al. ..... 174/268
6,255,773 B1 * 7/2001 Powers et al. ..... 313/496
6,422,907 B2 * 7/2002 Moradi et al. ..... 445/24
7,190,111 B2 * 3/2007 Lee et al. ..... 313/503
2002/0057045 A1 * 5/2002 Tsukamoto ..... 313/309
2004/0178718 A1 9/2004 Ito et al.
2007/0096623 A1 * 5/2007 Kato et al. ..... 313/496

FOREIGN PATENT DOCUMENTS

EP 1548794 A2 * 6/2005
JP 59-103247 6/1984
JP 2001-522519 11/2001
JP 2003-031150 1/2003
JP 2004-079256 3/2004
JP 2004-273376 9/2004

OTHER PUBLICATIONS

Japanese Office Action dated Mar. 31, 2009, for corresponding JP Patent Application 2005-319227.

* cited by examiner

*Primary Examiner*—Sikha Roy
*Assistant Examiner*—Tracie Green
(74) *Attorney, Agent, or Firm*—K&L Gates LLP

(57) ABSTRACT

A flat panel display is provided. The flat panel display includes a cathode panel in which a plurality of electron emission areas are provided on a support, and an anode panel in which a plurality of phosphor areas and an anode electrode are provided on a substrate. The cathode panel and the anode panel are joined together at their periphery by a joining member. The anode electrode includes an anode electrode central section covering the phosphor areas, and an anode electrode peripheral section surrounding the anode electrode central section and extending from the anode electrode central section and being provided in contact with the substrate. The average thickness of the anode electrode peripheral section is smaller than the average thickness of the anode electrode central section.

3 Claims, 22 Drawing Sheets

[STEP-C-120]

[STEP-C-130]

[STEP-C-140]

[STEP-C-150]

FLAT PANEL DISPLAY, METHOD OF MANUFACTURING ANODE PANEL FOR THE FLAT PANEL DISPLAY, AND METHOD OF MANUFACTURING CATHODE PANEL FOR THE FLAT PANEL DISPLAY

CROSS REFERENCES TO RELATED APPLICATIONS

The present application claims priority to Japanese Patent Application JP 2005-319227 filed in the Japanese Patent Office on Nov. 2, 2005, the entire contents of which is being incorporated herein by reference.

BACKGROUND

The present disclosure relates to a flat panel display, a method of manufacturing an anode panel for the flat panel display, and a method of manufacturing a cathode panel for the flat panel display.

Various flat panel types of displays have been investigated as image displays to be replaced with cathode ray tubes (CRTs) which are currently mainstream. Typical examples of flat panel displays are liquid crystal displays (LCDs), electroluminescence displays (ELDs) and plasma displays (PDPs). Development of flat panel displays in which a cathode panel provided with electron emitters is also proceeding. Known examples of the electron emitters are cold cathode field emitters, metal/insulator/metal devices (also called MIM devices), and surface-conduction electron emitters, and flat panel displays of the type in which a cathode panel provided with electron emitters made of such a cold cathode electron source is incorporated are attracting attention from the viewpoints of color display of high resolution and high luminance and low power consumption.

A cold cathode field emission display (hereafter referred to also simply as the display) which is a flat panel display in which cold cathode field emitters are incorporated as its field emitters generally has a construction in which a cathode panel CP provided with a plurality of cold cathode field emitters (hereinafter referred to also simply as the field emitters) and an anode panel AP having phosphor areas which are excited to emit light by colliding with electrons emitted from the electron emitters are arranged in opposition to each other across a space maintained in high vacuum, and the cathode panel CP and the anode panel AP are joined together at their periphery by a joining member. The cathode panel CP has electron emission areas corresponding to individual subpixels arranged in a two-dimensional pixel, and each of the electron emission areas is provided with one or a plurality of field emitters. Typical examples of field emitters are Spindt types, flat types, edge types, plane types and the like.

FIG. 20 shows a schematic end view, in fragmentary cross section, of a display having Spindt field emitters by way of example, and FIG. 22 shows a schematic exploded view, in fragmentary perspective, of the cathode panel CP and the anode panel AP. Each of the Spindt electron emitters which constitutes the display includes a cathode electrode 11 formed on a support 10, an insulation layer 12 formed on the support 10 and the cathode electrode 11, a gate electrode 13 formed on the insulation layer 12, an opening section 14 provided to extend through the gate electrode 13 and the insulation layer 12 (a first opening section 14A provided in the gate electrode 13 and a second opening section 14B provided in the insulation layer 12), and a conical electron emission section 15 formed on the section of the cathode electrode 11 that is positioned at the bottom of the opening section 14.

FIG. 21 shows a schematic end view, in fragmentary cross section, of a display having so-called flat electron emitters each having an approximately flat electron emission section 15A. Each of the flat electron emitters includes the cathode electrode 11 formed on the support 10, the insulation layer 12 formed on the support 10 and the cathode electrode 11, the gate electrode 13 formed on the insulation layer 12, the opening section 14 provided to extend through the gate electrode 13 and the insulation layer 12 (the first opening section 14A provided in the gate electrode 13 and the second opening section 14B provided in the insulation layer 12), and an electron emission section 15A formed on the section of the cathode electrode 11 that is positioned at the bottom of the opening section 14. The electron emission section 15A is made of, for example, a multiplicity of carbon nanotubes partially embedded in the matrix.

An interlayer insulation layer 16 is provided over the insulation layer 12 and the gate electrode 13, and an opening section (a third opening section 14C) which communicates with the first opening section 14A provided in the gate electrode 13 is provided in the interlayer insulation layer 16, and a focusing electrode 317 is provided to extend from the top surface of the interlayer insulation layer 16 to the side walls of the third opening section 14C. In FIGS. 21 and 22, the illustration of the interlayer insulation layer and the focusing electrode is omitted.

In each of the displays, the cathode electrode 11 has a strip-like shape extending in a first direction (in each of FIGS. 20, 21 and 22, the X direction), while the gate electrode 13 has a strip-like shape extending in a second direction (in each of FIGS. 20, 21 and 22, the Y direction) different from the first direction (the X direction). In general, the cathode electrode 11 and the gate electrode 13 are respectively formed in the strip-like shapes in the directions in which projected images of the cathode and gate electrodes 11 and 13 are orthogonal to each other. An area in which one strip-shaped cathode electrode 11 and one strip-shaped gate electrode 13 overlap each other is an electron emission area EA, which corresponds to one subpixel. The electron emission areas EA are generally arranged in a two-dimensional matrix with an effective area of the cathode panel CP. The effective area is a central display area serving as a display function which is a practical function of the flat panel display, and an ineffective area is positioned outside the effective area and surrounds the effective area in a frame-like manner.

The anode panel AP has a structure in which phosphor areas 22 (specifically, red light emitting phosphor areas 22R, green light emitting phosphor areas 22G, and blue light emitting phosphor areas 22B) are formed on a substrate 20 in a predetermined pattern and the phosphor areas 22 are covered with an anode electrode 324. A light absorption layer (a black matrix) 23 made of a light absorption material such as carbon is formed between each of the phosphor areas 22 in order to prevent occurrence of color haze and optical crosstalk in display images. Each of the phosphor areas 22 which constitutes one subpixel is surrounded by a partition wall 21, and the planar shape of the partition wall 21 is a grate-like shape (a double-cross shape). In FIG. 20, reference numeral 40 denotes a spacer, reference numeral 25 denotes a spacer holding section, and reference numeral 26 denotes a joining member. In FIGS. 21 and 22, the illustration of the partition wall, the spacer and the spacer holding section is omitted.

One subpixel is made of one electron emission area EA provided on the cathode panel CP and one phosphor area 22 provided on the anode panel AP opposed to (facing) the electron emission area EA. In the effective area, such pixels are arranged on the order of, for example, several hundred thousand to several million. In a color display, one pixel is made of a set of a red light emitting subpixel, a green light emitting subpixel and a blue light emitting subpixel. During the fabrication of the display, the anode panel AP and the cathode panel CP are arranged so that the respective phosphor areas 22 are opposed to the electron emission areas EA, and the anode panel AP and the cathode panel CP are joined together at their periphery by the joining member 26 and the space therebetween is evacuated and sealed, thereby fabricating the display. The space surrounded by the anode panel AP, the cathode panel CP and the joining member 26 is held under high vacuum (for example, not higher than $1\times10^{-3}$ Pa).

The presence of a foreign substance in the inside (space) of such a display is known as the cause of lowering the withstand voltage characteristics of the display to a significant extent. Measures against external foreign substances can be taken by means of manufacturing methods, manufacturing environments and the like all of which can prevent penetration of foreign substances into the display during the manufacturing process thereof.

However, in a heat treatment step of the manufacturing process of the display, there is a case where a kind of projection such as whiskers and/or hillocks is produced in the anode electrode 324 or the focusing electrode 317 made of aluminum. Incidentally, needle-shaped projections are called whiskers, and lump-shaped projections are called hillocks. Such projections in some cases become a cause of discharge when voltage is applied during the actual operation of the display. In addition, some of the projections are peeled by electrostatic force due to electric fields generated by voltage applied during the actual operation of the display, and become a foreign substance which is the cause of lowering the withstand voltage characteristics of the display to a significant extent.

It is believed that whiskers and hillocks are produced by compressive stresses due to the difference in thermal expansion between the anode electrode 324 or the focusing electrode 317 made of aluminum and the underlying base during a heat treatment step in the manufacturing process of the display. However, techniques for restraining the occurrence of whiskers and hillocks in the anode electrode 324 and the focusing electrode 317 have not yet been known.

For example, Japanese Patent Application Publication Number 2003-31150 discloses the technique of restraining generation of discharge by covering an anode electrode with oxide film or nitride film. However, this patent application publication does not include any description of the occurrence of whiskers and hillocks.

SUMMARY

The present disclosure therefore provides a flat panel display having a structure and a construction capable of restraining occurrence of whiskers and hillocks at an anode electrode and a focusing electrode to positively restrain degradation of withstand voltage characteristics and generation of discharge, as well as a method of manufacturing an anode panel and a cathode panel which constitute the flat panel display.

Therefore, a flat panel display according to a first aspect includes a cathode panel in which a plurality of electron emission areas are provided on a support, and an anode panel in which a plurality of phosphor areas and an anode electrode are provided on a substrate, the cathode panel and the anode panel being joined together at their periphery by a joining member, the anode electrode including an anode electrode central section covering the phosphor areas, and an anode electrode peripheral section surrounding the anode electrode central section and extending from the anode electrode central section and being provided in contact with the substrate, and the average thickness of the anode electrode peripheral section being smaller than the average thickness of the anode electrode central section.

According to the first aspect, there is provided a method of manufacturing an anode panel for a flat panel display which includes a cathode panel in which a plurality of electron emission areas are provided on a support, and an anode panel in which a plurality of phosphor areas and an anode electrode are provided on a substrate, the cathode panel and the anode panel being joined together at their periphery by a joining member. The method includes the steps of forming the phosphor areas on the substrate, and then forming an anode electrode which includes an anode electrode central section covering the phosphor areas and an anode electrode peripheral section surrounding the anode electrode central section and extending from the anode electrode central section, the average thickness of the anode electrode peripheral section being smaller than the average thickness of the anode electrode central section.

In the flat panel display according to the first aspect or in the method of manufacturing the anode panel according to the first aspect, the anode panel can be formed of aluminum or aluminum alloy, and is preferably formed by a physical vapor deposition method (a PVD method). $0.1 \leqq t_P/t_C \leqq 0.5$ is preferably satisfied, where $t_P$ denotes the average thickness of the anode electrode peripheral section and $t_C$ denotes the average thickness of the anode electrode central section. Otherwise, $0.05\ \mu m \leqq t_P \leqq 0.1\ \mu m$ and $0.2\ \mu m \leqq t_C \leqq 0.5\ \mu m$ are preferably satisfied.

In the method of manufacturing the anode according to the first aspect, the anode electrode which includes the anode electrode central section and the anode electrode peripheral section is formed, but the anode electrode central section may be first formed and then the anode electrode peripheral section may be formed, or the anode electrode peripheral section may be first formed and then the anode electrode central section may be formed, or the lower layer section of the anode electrode central section and the anode electrode peripheral section may be first formed and then the upper layer section of the anode electrode central section may be formed.

A flat panel display according to a second aspect includes a cathode panel in which a plurality of electron emission areas are provided on a support, and an anode panel in which a plurality of phosphor areas and an anode electrode are provided on a substrate, the cathode panel and the anode panel being joined together at their periphery by a joining member. The anode electrode includes an anode electrode central section covering the phosphor areas and an anode electrode peripheral section surrounding the anode electrode central section and being provided in contact with the substrate, the anode electrode central section being made of a first conductive material, the anode electrode peripheral section being made of a second conductive material different from the first conductive material.

According to the second aspect, there is provided a method of manufacturing an anode panel for a flat panel display which includes a cathode panel in which a plurality of electron emission areas are provided on a support and an anode panel in which a plurality of phosphor areas and an anode electrode are provided on a substrate, the cathode panel and the anode panel being joined together at their periphery by a joining member. The method includes the steps of forming the phosphor areas on the substrate and then forming an anode electrode which includes an anode electrode central section covering the phosphor areas and an anode electrode peripheral section surrounding the anode electrode central section and extending from the anode electrode central section, the anode electrode central section being made of a first conductive material, the anode electrode peripheral section being made of a second conductive material different from the first conductive material.

In the flat panel display according to the second aspect or in the method of manufacturing the anode panel according to the second aspect, the first conductive material is preferably aluminum or aluminum alloy, and the second conductive material is preferably a material which does not allow resist whiskers and hillocks to occur easily and satisfies electrical characteristics (for example, voltage drops and high voltage stability) required for the flat panel display. The second conductive material is, specifically, at least one kind of material selected from the group consisting of carbon, silicon carbide, and chromium.

In the method of manufacturing the anode according to the second aspect, the anode electrode which includes the anode electrode central section and the anode electrode peripheral section is formed, but the anode electrode central section may be first formed and then the anode electrode peripheral section may be formed, or the anode electrode peripheral section may be first formed and then the anode electrode central section may be formed.

A flat panel display according to a third aspect includes a cathode panel in which a plurality of electron emission areas are provided on a support and an anode panel in which a plurality of phosphor areas and an anode electrode are provided on a substrate, the cathode panel and the anode panel being joined together at their periphery by a joining member, the anode electrode being made of aluminum alloy to restrain occurrence of whickers and/or hillocks which cause discharge at the anode electrode.

In the flat panel display according to the third aspect, the aluminum alloy is at least one kind of alloy selected from the group consisting of Al—Cr alloy, Al—Si alloy, Al—Nd alloy, Al—Mn alloy, Al—Zr alloy, Al—Ta alloy, Al—Mo alloy, Al—W alloy, Al—Ti alloy, and Al—Mg alloy. Otherwise, it is preferable to form an alloying blocking layer (made of, for example, an oxide film such as $SiO_2$ or a nitride film such as SiN) under the anode electrode and form a reflecting layer made of aluminum under the alloying blocking layer, from the viewpoint that light emitted from the phosphor areas toward the anode electrode central section can be positively reflected and emitted from the anode panel to increase the luminance of the flat panel display. In the flat panel display according to the third aspect, the anode electrode may be formed of aluminum alloy entirely in the thickness direction of the anode electrode, or the surface of the anode electrode may be formed of aluminum alloy and the other section of the anode electrode (the section of the anode electrode that is closer to the substrate in the thickness direction of the anode electrode) may be formed of aluminum.

According to the third aspect, there is provided a method of manufacturing an anode panel for a flat panel display which includes a cathode panel in which a plurality of electron emission areas are provided on a support and an anode panel in which a plurality of phosphor areas and an anode electrode are provided on a substrate, the cathode panel and the anode panel being joined together at their periphery by a joining member, the method includes the steps of forming the phosphor areas on the substrate, then forming an aluminum layer covering at least the phosphor areas, then forming an alloying layer on the aluminum layer, and then applying heat treatment to the aluminum layer and the alloying layer to cause the aluminum layer and the alloying layer to react with each other, to obtain the anode electrode made of aluminum alloy.

In a method of manufacturing the anode panel according to the third aspect, the alloying layer is preferably at least one kind of material selected from the group consisting of Cr, Si, Nd, Mn, Zr, Ta, Mo, W, Ti and Mg. Otherwise, it is preferable to form a reflecting layer made of aluminum covering at least the phosphor areas after forming the phosphor areas on the substrate, and then subsequently forming the alloying blocking layer and the aluminum layer on the reflecting layer, from the viewpoint that light emitted from the phosphor areas toward the anode electrode central section can be positively reflected and emitted from the anode panel to increase the luminance of the flat panel display. The thickness of the alloying layer may be, for example, 10 nm to 50 nm, preferably 20 nm to 30 nm. Incidentally, if the thickness of the alloying layer is too small, a section in which is not in the state of a continuous layer occurs in the alloying layer, so that insufficient alloying is liable to result. Otherwise, $0.02 \leqq T_2/T_1 \leqq 0.5$ or $0.05 \leqq T_2/T_1 \leqq 0.3$ is preferably satisfied, where $T_1$ denotes the thickness of the aluminum layer and $T_2$ denotes the thickness of the alloying layer. In the method of manufacturing the anode panel according to the third aspect, the anode electrode may be formed of aluminum alloy entirely in the thickness direction of the anode electrode, or the surface of the anode electrode may be formed of aluminum alloy and the other section of the anode electrode (the section of the anode electrode that is closer to the substrate in the thickness direction of the anode electrode) may be formed of aluminum.

In the method of manufacturing the anode panel according to the third aspect, or in a method of manufacturing the cathode panel according to the first aspect as will be mentioned later), the aluminum layer is first formed and then the alloying layer is formed on the aluminum layer, but it is preferable to prevent the aluminum layer from being exposed to the air during the process between the formation of the aluminum layer and the formation of the alloying layer from the viewpoint that oxide film can be prevented from being formed on the surface of the aluminum layer. One example of the heat treatment applied to the aluminum layer and the alloying layer is a heat treatment method of holding a heat treatment of 350° C. to 400° C. for approximately 70 minutes to 80 minutes under the condition that the total heat treatment time is set to, for example, approximately 10 hours, although depending on the kind of material constituting the alloying layer.

According to a fourth aspect, there is provide a method of manufacturing an anode panel for a flat panel display which includes a cathode panel in which a plurality of electron emission areas are provided on a support and an anode panel in which a plurality of phosphor areas and an anode electrode are provided on a substrate, the cathode panel and the anode panel being joined together at their periphery by a joining member. The method includes the steps of forming the phosphor areas on the substrate and then forming the anode electrode made of aluminum layer covering at least the phosphor areas to restrain occurrence of whiskers and/or hillocks which cause discharge at the anode electrode.

In the method of manufacturing the anode panel according to the fourth aspect, the aluminum alloy is at least one kind of alloy selected from the group consisting of Al—Cr alloy, Al—Si alloy, and Al—Nd alloy. In the method of manufacturing the anode panel according to the fourth aspect of the present invention, the anode electrode is formed of aluminum alloy entirely in the thickness direction of the anode electrode.

According to the fourth aspect, there is provided a flat panel display which includes a cathode panel in which a plurality of electron emission areas provided with a focusing electrode are provided on a support and an anode panel in which a plurality of phosphor areas and an anode electrode are provided on a substrate, the cathode panel and the anode panel being joined together at their periphery by a joining member, the section of each of the electron emission areas that is opposed to the anode electrode being formed by the focusing electrode, the focusing electrode being made of aluminum alloy to restrain occurrence of whiskers and/or hillocks which cause discharge at the anode electrode.

In the flat panel display according to the fourth aspect, the aluminum alloy is at least one kind of alloy selected from the group consisting of Al—Cr alloy, Al—Si alloy, Al—Nd alloy, Al—Mn alloy, Al—Zr alloy, Al—Ta alloy, Al—Mo alloy, Al—W alloy, Al—Ti alloy, and Al—Mg alloy. In the flat panel display according to the fourth aspect, the focusing electrode may be formed of aluminum alloy entirely in the thickness direction of the focusing electrode, or the surface of the focusing electrode may be formed of aluminum alloy and the other section of the focusing electrode (the section of the focusing electrode that is closer to the support in the thickness direction of the focusing electrode) may be formed of aluminum.

According to the first aspect, there is provided a method of manufacturing a cathode panel for a flat panel display which includes a cathode panel in which a plurality of electron emission areas provided with a focusing electrode are provided on a support and an anode panel in which a plurality of phosphor areas and an anode electrode are provided on a substrate, the cathode panel and the anode panel being joined together at their periphery by a joining member. The method includes the steps of forming the phosphor areas on the substrate, then forming an aluminum layer covering at least the phosphor areas, then forming an alloying layer on the aluminum layer, and then applying heat treatment to the aluminum layer and the alloying layer to cause the aluminum layer and the alloying layer to react with each other, to obtain the anode electrode made of aluminum alloy.

In the method of manufacturing the cathode panel according to the first aspect, the alloying layer is preferably at least one kind of material selected from the group consisting of Cr, Si, Nd, Mn, Zr, Ta, Mo, W, Ti and Mg. The thickness of the alloying layer may be, for example, 10 nm to 50 nm, preferably 20 nm to 30 nm. Incidentally, if the thickness of the alloying layer is too small, a section in which is not in the state of a continuous layer occurs in the alloying layer, so that insufficient alloying is liable to result. Otherwise, $0.02 \leqq T'_2/T'_1 \leqq 0.5$ or $0.05 \leqq T'_2/T'_1 \leqq 0.3$ is preferably satisfied, where $T'_1$ denotes the thickness of the aluminum layer and $T'_2$ denotes the thickness of the alloying layer. In the method of manufacturing the cathode panel according to the first aspect of the present invention, the cathode electrode may be formed of aluminum alloy entirely in the thickness direction of the cathode electrode, or the surface of the cathode electrode may be formed of aluminum alloy and the other section of the cathode electrode (the section of the cathode electrode that is closer to the support in the thickness direction of the anode electrode) may be formed of aluminum.

According to the second aspect, there is provided a method of manufacturing a cathode panel for a flat panel display which includes a cathode panel in which a plurality of electron emission areas provided with a focusing electrode are provided on a support and an anode panel in which a plurality of phosphor areas and an anode electrode are provided on a substrate, said cathode panel and said anode panel being joined together at their periphery by a joining member. The method includes the step of forming said focusing electrode made of aluminum alloy to restrain occurrence of whickers and/or hillocks which cause discharge at said focusing electrode.

In the method of manufacturing said cathode panel according to the second aspect, the aluminum alloy is at least one kind of alloy selected from the group consisting of Al—Cr alloy, Al—Si alloy, and Al—Nd alloy. In the method of manufacturing the cathode panel according to the second aspect, the cathode electrode may be formed of aluminum alloy entirely in the thickness direction of the cathode electrode.

In the flat panel display according to each of the first to third aspects including the above-mentioned preferred embodiments and constructions as well as in the method of manufacturing the anode panel according to each of the first to fourth aspects, the content by percentage of the material (for example, Cr, Si, Nd, Mn, Zr, Ta, Mo, W, Ti, or Mg) that constitutes the aluminum alloy is preferably a content by percentage which enables an emission efficiency of 80% or more, preferably 90% or more, when an emission efficiency achievable by the use of pure aluminum is assumed to be 100%, from the viewpoint that it is necessary to prevent a decrease in luminance of the flat panel display. Otherwise, the content by percentage of such material is preferably a content by percentage which serves to minimize the absolute value of the difference in coefficient of thermal expansion between the aluminum alloy layer and the underlying base, from the viewpoint that the occurrence of whiskers and/or hillocks can be restrained to a further extent. In addition, in the flat panel display according to the fourth aspect including the above-mentioned preferred embodiments and constructions as well as in the method of manufacturing the cathode panel according to each of the first and second aspects, the absolute value of the difference in coefficient of thermal expansion between the aluminum alloy layer and the underlying base is preferably as small as possible from the viewpoint that the occurrence of whiskers and/or hillocks can be restrained to a further extent.

The method of forming the anode electrode (including an anode electrode unit which will be described later) may use, for example, various PVD methods including vacuum deposition methods such as an electron beam deposition method and a filament deposition method, a sputtering method, an ion plating method and a laser abrasion method; various CVD chemical vapor deposition methods (CVD methods); a screen printing method; a metal mask method; a lift-off method; and a sol-gel method. Namely, after a conductive material layer is formed, the conductive material layer is patterned on the basis of lithography techniques and etching techniques, thereby forming the cathode electrode. Otherwise, the anode electrode may be obtained by forming a conductive material on the basis of a PVD method or a screen printing method by means of a mask or a screen having a pattern corresponding to the anode electrode. In the flat panel display according to each of the second to fourth aspects of the present invention, the average thickness of the anode electrode on the substrate (or over the substrate) may be, for example, $3\times10^{-8}$ m (30 nm) to $5\times10^{-7}$ m (0.5 μm), preferably $5\times10^{-8}$ m (50 nm) to $3\times10^{-7}$ m (0.3 μm).

The anode electrode may be formed by one anode electrode as a whole or by a plurality of anode electrode units. In the latter case, the anode electrode units are preferably electrically connected to one another by an anode electrode resistor layer. A material which constitutes the anode electrode resistor layer may use, for example, a carbon-type material such as carbon, silicon carbide (SiC) or SiCN; a SiN-type material; a high-melting metal oxide or a high-melting metal nitride such as ruthenium oxide ($RuO_2$), tantalum oxide, tantalum nitride, chromium oxide or titanium oxide; a semiconductor material such as amorphous silicon; or ITO. In addition, it is also possible to realize a desired stable sheet resistance value by a combination of a plurality of films such as a carbon thin film of low resistance value stacked on a SiC resistance film. The sheet resistance value of the anode electrode resistor layer may be, for example, $1\times10^{-1}\Omega/\square$ to $1\times10^{10}\Omega/\square$, preferably $1\times10^{3}\Omega/\square$ to $1\times10^{8}\Omega/\square$. The number (Q) of the anode electrode units may be not less than 2; for example, if the total number of columns of linearly arranged phosphor areas is assumed to be q columns, Q=q or q=k·Q (k is an integer not less than 2, preferably $10\leqq k\leqq100$, more preferably $20\leqq k\leqq50$; the sum of 1 and the number of spacers arranged at constant intervals; a number coinciding with the number of pixels or the number of subpixels; or an integral submultiple of the number of pixels or the number of subpixels. The size of each the anode electrode units may be made the same irrespective of the positions of the respective anode electrode units, or may be made different depending on the positions of the respective anode electrode units. The anode electrode resistor layer may be formed on one anode electrode as a whole. Accordingly, by forming the anode electrode from divided anode electrode units each having a small area instead of forming the anode electrode on approximately the entire surface of the effective area, it is possible to reduce the electrostatic capacity between the anode electrode units and the election emission areas. Consequently, it is possible to reduce occurrence of discharge and it is also possible to effectively reduce occurrence of damage to the anode electrode or the election emission areas due to discharge.

In addition, the anode electrode resistor layer can also be formed by a method which is the same as or similar to the method of forming the anode electrode. Namely, it is possible to adopt a method of forming an anode electrode resistor layer from a resistor material and patterning the anode electrode resistor layer on the basis of lithography techniques or etching techniques, or it is also possible to adopt a method of obtaining an anode electrode resistor layer by forming a resistor material on the basis of a PVD method or a screen printing method by means of a mask or a screen having a pattern corresponding to the anode electrode resistor layer.

In the case where the anode electrode is formed of anode electrode units, if partition walls (which will be described later) are formed, each of the anode electrode units can be formed to extend from a respective one of the phosphor areas to the side surface of the corresponding one of the partition walls. In addition, each of the anode electrode units may also be formed from a respective one of the partition walls to an intermediate location on the side surface of the corresponding one of the partition walls.

Each of the phosphor areas may be made of monochromic phosphor particles or phosphor particles for the three primary colors. The arrangement of the phosphor areas is expressed in a dotted pattern, for example. Specifically, if the flat panel display is a color display, the arrangement of the phosphor areas may be one of a delta arrangement, a stripe arrangement, a diagonal arrangement and a rectangle arrangement. Namely, one column of linearly arranged phosphor areas may be formed by a column occupied by red light emitting phosphor areas alone, a column occupied by green light emitting phosphor areas along, and a column occupied by blue light emitting phosphor areas alone, or it may be formed by a column in which a red light emitting phosphor area, a green light emitting phosphor area and a blue light emitting phosphor area are arranged in order. The term "phosphor area" used herein is defined as an area of phosphor to generate one spot on the anode panel. One pixel is formed by a set of one red light emitting phosphor area, one green light emitting phosphor area, and one blue light emitting phosphor area, and one subpixel is formed by one phosphor area (one red light emitting phosphor area, or one green light emitting phosphor area, or one blue light emitting phosphor area). In addition, a light absorption layer (a black matrix) for contrast improvement may be formed between each adjacent one of the phosphor areas.

The phosphor areas can be formed by a method using luminous crystalline particle composites which are prepared from luminous crystalline particles, for example, a method including the steps of coating the entire surface with a luminous crystalline particle composite of red photosensitivity (a red phosphor slurry) and performing exposure and development of the luminous crystalline particle composite to form a red light emitting phosphor area, then coating the entire surface with a luminous crystalline particle composite of green photosensitivity (a green phosphor slurry) and performing exposure and development of the luminous crystalline particle composite to form a green light emitting phosphor area, and then coating the entire surface with a luminous crystalline particle composite of blue photosensitivity (a blue phosphor slurry) and performing exposure and development of the luminous crystalline particle composite to form a blue light emitting phosphor area. Otherwise, after a red light emitting phosphor slurry, a green light emitting phosphor slurry and a blue light emitting phosphor slurry have been sequentially coated, each of the phosphor slurries may be sequentially exposed and developed to form each phosphor area, or each phosphor area may be formed by a screen printing method, an ink-jet method, a float coating method, a precipitation coating method, a phosphor film transfer method or the like. The average thickness of the phosphor areas on the substrate is, but not limited to, 3 μm to 20 μm, preferably 5 μm to 10 μm. Phosphor materials which constitute the luminous crystalline particles can be suitably selected from among conventionally known phosphor materials. In the case of color display, it is preferable to combine phosphor materials which are close in color purity to the three primary colors specified by NTSC and can optimize white balance when the three primary colors are mixed, and which have short afterglow periods and provide approximately equal afterglow periods for the three primary colors.

A light absorption layer which absorbs light from the phosphor areas is preferably formed between each adjacent one of the phosphor areas or between the partition walls and the substrate from the viewpoint of an improvement in contrast of display images. The light absorption layer functions as a so-called black matrix. A material which constitutes the light absorption layer is preferably selected from among materials capable of absorbing not less than 90% of light from the phosphor areas. Such materials can be selected from among carbon, metal thin films (for example, chromium, nickel, aluminum, molybdenum and alloys of these metals), metal oxides (such as chromium oxide), metal nitrides (such as chromium nitride), heat-resistant organic resins, glass pastes, and glass pastes containing a black pigment or conductive particles such as silver and the like. Specifically, the material of the light absorption layer can be selected from a photosensitive polyimide resin, chromium oxide and a chromium oxide/chromium stacked film. In the chromium oxide/chromium stacked film, the chromium film is in contact with the substrate. The light absorption layer can be formed by, for example, a combination of a vacuum vapor deposition method or a sputtering method and an etching method, or a combination of a vacuum vapor deposition method or a sputtering method, a spin-coating method and a lift-off method, or a method, such as a screen printing method or a lithography technique, which is appropriately selected depending on the kind of material used.

The partition walls are preferably provided in order to prevent so-called backscattered electrons, such as electrons recoiling from one of the phosphor areas or secondary electrons emitted from one of the phosphor areas, from entering other phosphor areas and causing so-called optical crosstalk (color haze).

A method of forming the partition walls can be selected from among, for example, a screen printing method, a dry film method, an exposure method, a casting method and a sandblast forming method. The screen printing method is a method of forming an opening in the section of a screen that corresponds to a section in which to form a partition wall, passing a partition wall forming material on the screen through the opening by using a squeezee, forming the partition wall forming material on a substrate, and firing the partition wall forming material. The dry film method is a method of laminating a photosensitive film on a substrate, removing the photosensitive film from a section in which to form a partition wall, by exposure and development, charging the partition wall forming material into the opening exposed by removal, and firing the partition wall forming material. The photosensitive film is combusted and removed by firing, so that the partition wall forming material charged into the opening is left as a partition wall. The exposure method is a method of forming a partition wall forming material having photosensitivity on a substrate, patterning the partition wall forming material by exposure and development, and firing (curing) the partition wall forming material. The casting method (a die-stamping method) is a method of forming a partition wall forming material by extruding the partition wall forming material made of an organic paste material or an inorganic paste material onto a substrate from a die (a cast), and firing the partition wall forming material. The sandblast forming method is a method of forming a partition wall forming material on a substrate by using, for example, a screen printing method, a metal mask printing method, a roll coater, a doctor blade or a nozzle spray type coater, drying the partition wall forming material, coating the section of the partition wall forming material in which to form a partition wall, by means of a mask layer, and removing the exposed section of the partition wall forming material by a sandblast method. In addition, after partition walls have been formed, the partition walls may be polished to flatten the top surfaces of the partition walls.

The partition wall forming material can be selected from among, for example, photosensitive polyimide resin, lead glass colored in black by a metallic oxide such as cobalt oxide, $SiO_2$, and a low-melting glass paste. A protective layer (made of, for example, $SiO_2$, SiON or AlN) for preventing electron beams from colliding with the partition walls to discharge gases from the partition walls may be formed on the surfaces (the top and side surfaces) of each of the partition walls.

The planar shape of the section of each of the partition walls that surrounds a respective one of the phosphor areas (the planar shape corresponds to the inner contour of a projected image of the side surfaces of each of the partition walls, and is a kind of opening area) can be selected from among, for example, a rectangular shape, a circular shape, an elliptical shape, a long elliptical shape, a triangular shape, a polygonal shape having sides more than a pentagon has, a roundish triangular shape, a roundish rectangular shape, and a roundish polygonal shape. Such planar shapes (the planar shapes of the respective opening areas) are arranged in a two-dimensional matrix so that the partition walls are formed in a grate-like shape. The two-dimensional arrangement may be, for example, a parallel cross shape arrangement or a staggered arrangement.

In the flat panel display according to each of the first to fourth aspects including the above-mentioned preferred embodiments and constructions and in the method of manufacturing the anode panel according to each of the first to fourth aspects as well as in the method of manufacturing the cathode panel according to each of the first and second aspects (all of the flat panel displays and the methods will also be hereinafter referred to simply as the present embodiments), the support which constitutes the anode panel or the support which constitutes the cathode panel can be preferably selected from among a glass substrate, a glass substrate having an insulation film formed on its surface, a quartz substrate, a quartz substrate having an insulation film formed on its surface, and a semiconductor substrate having an insulation film formed on its surface. From the viewpoint of a reduction in manufacturing cost, it is preferable to use a glass substrate or a glass substrate having an insulation film formed on its surface. Such a glass substrate can be selected from among high-distortion-point glass, soda glass ($Na_2O.CaO.SiO_2$), borosilicate glass ($Na_2O.B_2O_3.SiO_2$), forsterite ($2MgO.SiO_2$), lead glass ($Na_2O.PbO.SiO_2$), and non-alkaline glass.

In the present embodiments, electron emitters which constitute each of the election emission areas may be cold cathode field emitters (hereinafter referred to as the field emitters), metal/insulator/metal devices (also called MIM devices), or surface-conduction electron emitters. The flat panel display may be a flat panel display provided with cold cathode field emitters (a cold cathode field emission display), a flat panel display in which MIM devices are incorporated, or a flat panel display in which surface-conduction electron emitters are incorporated.

In the cold cathode field emission display, strong fields produced by voltages applied across its cathode electrodes and its gate electrodes are applied to its electron emission sections, so that electrons are emitted from the electron emission sections by a quantum tunnel effect. These electrons are attracted to its anode panel by an anode electrode provided on the anode panel and collides with its phosphor areas. Then, as the result of the collision of the electrons against the phosphor areas, the phosphor areas emit light to form a recognizable image.

In the cold cathode field emission display, the cathode electrode is connected to a cathode electrode control circuit, the gate electrodes are connected to a gate electrode control circuit, and the anode electrode is connected to an anode electrode control circuit. In addition, these control circuits can be formed of known circuits. During actual operation, the output voltage $V_A$ of the anode electrode control circuit is normally constant and may be, for example, in the range between 5 kilovolts and 15 kilovolts. Otherwise, the value of $V_A/d_0$ (unit: kilovolt/mm) is desirably between 0.5 and 20, preferably between 1 and 10, more preferably between 4 and 8, where $d_0$ denotes the distance between the anode panel and the cathode panel. During the actual operation of the cold cathode field emission display, a voltage modulation method can be adopted as a gradation control method for a voltage $V_C$ to be applied to the cathode electrodes and a voltage $V_G$ to be applied to the gate electrodes.

More specifically, a field emitter includes (a) a strip-shaped cathode electrode formed on a support and extended in a first direction, (b) an insulation layer formed on a cathode electrode and the support, (c) a strip-shaped gate electrode formed on the insulation layer and extended in a second direction different from the first direction, (d) an opening section provided in the sections of the gate electrode and the insulation layer that are located in an overlap section (an overlap area) in which the cathode electrode and the gate electrode overlap each other, the cathode electrode being exposed at the bottom of the opening section, and (e) an electron emission section formed on the section of the cathode electrode that is exposed at the bottom of the opening section, and able to be controlled in its electron emission by the application of voltages to the cathode electrode and the gate electrode.

The type of the field emitter should not be considered limitting, and may be a Spindt field emitter (a field emitter in which a conical electron emission section is provided on the section of the cathode electrode that is located at the bottom of the opening section) or a flat field emitter (a field emitter in which an approximately flat electron emission section is provided on the section of the cathode electrode that is located at the bottom of the opening section).

In the cathode panel, a projected image of the cathode electrode and a projected image of the gate electrode, i.e., the first direction and the second direction, are preferably orthogonal to each other from the viewpoint of simplification of the structure of the cold cathode field emission display. In the cathode panel, the overlap section (the overlap area) in which the cathode electrode and the gate electrode overlap each other corresponds to an election emission area, and a plurality of election emission areas are arranged in a two-dimensional matrix and one or a plurality of field emitters are provided in each of the election emission areas.

In general, a field emitter can be manufactured by the following method including:

(1) forming a cathode electrode on a support, (2) forming an insulation layer on the entire surface (on the support and the cathode electrode), (3) forming a gate electrode on the insulation layer, (4) forming an opening section in the sections of the gate electrode and the insulation layer that are located in an overlap section (an overlap area) in which the cathode electrode and the gate electrode overlap each other, and exposing the cathode electrode at the bottom of the opening section, and (5) forming an electron emission section on the section of the cathode electrode that is located at the bottom of the opening section.

Otherwise, a field emitter can also be manufactured by the following method including the steps of:

(1) forming a cathode electrode on a support, (2) forming an electron emission section on the cathode electrode, (3) forming an insulation layer on the entire surface (on the support and the cathode electrode, or on the support, the cathode electrode and the electron emission section), (4) forming a gate electrode on the insulation layer, and (5) forming an opening section in the sections of the gate electrode and the insulation layer that are located in an overlap section (an overlap area) in which the cathode electrode and the gate electrode overlap each other, and exposing the cathode electrode at the bottom of the opening section.

In the flat panel display according to each of the first to third aspects of the present invention, the field emitters which constitute each of the electron emission areas may be provided with a focusing electrode. Namely, each of the field emitters may have, for example, a construction in which an interlayer insulation layer is provided on the gate electrode and the insulation layer and a focusing electrode is provided on the interlayer insulation layer, or a construction in which a focusing electrode is provided over the gate electrode. In the flat panel display according to the fourth aspect of the present invention, for example, an interlayer insulation is provided on the gate electrode and the insulation layer, and a focusing electrode is provided on the interlayer insulation layer or a focusing electrode is provided over the gate electrode. The focusing electrode is an electrode for focusing the orbits of electrons emitted from the opening section toward the anode electrode to enable an improvement in luminance and prevention of optical crosstalk between adjacent pixels. In a so-called high voltage type of cold cathode field emission display in which the potential difference between the anode electrode and the cathode electrode is on the order of not less than several kilovolts and the distance between the anode electrode and the cathode electrode is comparatively long, the focusing electrode is particularly effective. A relatively negative voltage (for example, 0 volts) is applied to the focusing electrode from a focusing electrode control circuit. The focusing electrode need not necessarily be formed in such a manner that a plurality of focusing electrodes individually surround the electron emission sections or the election emission areas which are respectively formed in the overlap areas in each of which one the cathode electrode and one of the gate electrodes overlap each other. For example, the focusing electrode may be constructed in such a manner that focusing electrodes are extended along a predetermined arrangement direction of the electron emission sections or the election emission areas, or in such a manner that all the electron emission sections or all the election emission areas are surrounded by one focusing electrode (namely, the focusing electrode may also have a structure like one thin sheet which covers the entire effective area). According to this construction, it is possible to exert a common focusing effect on a plurality of electron emission sections or election emission areas. In addition, a third opening section is formed in the focusing electrode and the interlayer insulation layer.

The constituent material of the cathode and gate electrodes can be selected from among: various metals such as chromium (Cr), aluminum (Al), tungsten (W), niobium (Nb), tantalum (Ta), molybdenum (Mo), copper (Cu), gold (Au), silver (Ag), titanium (Ti), nickel (Ni), cobalt (Co), zirconium (Zr), iron (Fe), platinum (Pt), and zinc (Zn); alloys (for example, MoW) or compounds containing these metallic elements (for example, nitrides such as TiN, or silicides such as $WSi_2$, $MoSi_2$, $TiSi_2$ and $TaSi_2$); semiconductors such as silicon (Si); carbon thin films such as diamond films; and conductive metal oxides such as ITO (indium-tin oxide), indium oxide and zinc oxide. A method of forming the cathode and gate electrodes can be selected, for example, from among: a combination of an etching method and a vapor deposition method such as an electron beam evaporation method or a hot-filament evaporation method, a sputtering method, a CVD method or an ion plating method; a screen printing method; a plating method (an electrical plating method or an electroless plating method); a lift-off method; a laser abrasion method; and a sol-gel method. According to a screen printing method and a plating method, it is possible to directly form, for example, strip-shaped cathode electrodes and gate electrodes. In the flat panel display according to each of the first to third aspects of the present invention, in the case where the focusing electrode is provided, the constituent material of the focusing electrode can be selected from among the above-mentioned constituent materials of the cathode and gate electrodes (excluding aluminum). In the flat panel display according to each of the first to third aspects of the present invention, in the case where the focusing electrode is provided, if aluminum is used as the constituent material of the focusing electrode, the focusing electrode is preferably constructed similarly to that used in the flat panel display according to the fourth aspect of the present invention.

In the Spindt field emitter, a material which constitutes its electron emission section is at least one kind of material selected from the group consisting of molybdenum, molybdenum alloy, tungsten, tungsten alloy, titanium, titanium alloy, niobium, niobium alloy, tantalum, tantalum alloy, chromium, chromium alloy, and silicon containing impurities (polysilicon and amorphous silicon). The electron emission section of the Spindt field emitter can also be formed by not a vacuum evaporation method but, for example, a sputtering method or a CVD method.

In the flat field emitter, a material which constitutes its electron emission section is preferably selected from among materials which are smaller in work function $\Phi$ than the materials which constitute its cathode electrodes, and what kind of material should be selected may be determined on the basis of the work function of a material constituting the cathode electrode, the potential difference between its gate electrodes and the cathode electrodes, the required magnitude of emitted electron current density, and the like. Otherwise, as occasion demands, the material which constitutes the electron emission section may be selected from among materials whose secondary electron yield $\delta$ is larger than the secondary electron yield $\delta$ of a conductive material which constitutes the cathode electrode. In the flat field emitter, a particularly preferred constituent material of the election emission section is carbon, more specifically, one kind of material selected from among amorphous diamond, graphite, carbon nanotube structures (carbon nanotubes and/or graphite nanofibers), ZnO whiskers, MgO whiskers, $SnO_2$ whiskers, MnO whiskers, $Y_2O_3$ whiskers, NiO whiskers, ITO whiskers, $In_2O_3$ whiskers, and $Al_2O_3$ whiskers. In addition, the material which constitutes the electron emission section need not necessarily have conductivity.

A $SiO_2$-type material such as $SiO_2$, BPSG, PSG, BSG, AsSG, PbSG, SiON, SOG (spin on glass), low-melting glass or glass paste, a SiN-type material, and an insulative resin such as polyimide can be used individually or in combination as the constituent material of each of the insulation layer and the interlay insulation layer. The formation of the insulation layer and the interlayer insulation can use known processes such as a CVD method, a coating method, a sputtering method and a screen printing method.

The planar shape of a first opening section (an opening section formed in the gate electrode) or a second opening section (an opening section formed in the insulation layer) (the planar shape is the shape of such opening section which is cut in an imaginary plane parallel with the surface of the support) can be selected from among arbitrary shapes, for example, a circular shape, an elliptical shape, a rectangular shape, a polygonal shape, a roundish rectangular shape, and a roundish polygonal shape. The formation of the first opening section can be performed by, for example, anisotropic etching, isotropic etching, or a combination of anisotropic etching and isotropic etching, or the first opening section can be directly formed depending on the method of forming the gate electrode. Similarly, the formation of the second opening section can be performed by, for example, anisotropic etching, isotropic etching, or a combination of anisotropic etching and isotropic etching. The formation of the third opening second provided in the focusing electrode and the interlayer insulation layer can also be performed by the same method.

Although depending on the structure of the field emitter, in the field emitter, one electron emission section may be present in one opening section, or a plurality of electron emission sections may be present in one opening section, or a plurality of first opening sections may be provided in the gate electrode and one second opening section communicating with the plurality of first opening sections may be provided in the insulation layer so that one or a plurality of electron emission sections are present in the one second opening section provided in the insulation layer.

In the field emitter, a resistor thin film may also be formed between the cathode electrode and the electron emission section. By forming the resistor thin film, it is possible to realize stabilization of the operation of the field emitter and uniformization of the electron emission characteristic of the field emitter. A material which constitutes the resistor thin film can be selected from among, for example, carbon-type resistor materials such as silicon carbide (SiC) and SiCN, semiconductor resistor materials such as SiN and amorphous silicon, and high-melting metal oxide or high-melting metal nitrides such as ruthenium oxide ($RuO_2$), tantalum oxide and tantalum nitride. A method of forming the resistor thin film can be selected from, for example, a sputtering method, a CVD method and a screen printing method. The electrical resistance value of one electron emission section is approximately $1\times10^6$ to $1\times10^{11}\Omega$, preferably several tens of gigaohms.

The cathode panel and the anode panel are joined together at their periphery, and the joining of these panels may be performed by using a joining member made of an adhesive layer or by using a stick- or frame-shaped joining member which is made of an adhesive layer and a frame formed of an insulative rigid material such as glass or ceramic. If the joining member made of the frame and the adhesive layer is used, the distance between the cathode panel and the anode panel can be made longer than the joining member made of the adhesive layer alone by appropriately selecting the height of the frame. The constituent material of the adhesive layer generally uses a $B_2O_3$—PbO-type frit glass or a $SiO_2$—$B_2O_3$—PbO-type frit glass, but a so-called low-melting metallic material having a melting point of 120 to 400° C. may be used. The low-melting metal material can be selected from among, for example, In (indium: melting point 157° C.), an indium-gold type of low-melting alloy, tin (Sn)-type high-temperature solder such as $Sn_{80}Ag_{20}$ (melting point 220-370° C.) and $Sn_{95}Cu_5$ (melting point 227-370° C.), lead (Pb)-type high-temperature solder such as $Pb_{97.5}Ag_{2.5}$ (melting point 304° C.), $Pb_{94.5}Ag_{5.5}$ (melting point 304-365° C.) and $Pb_{97.5}Ag_{1.5}Sn_{1.0}$ (melting point 309° C.), zinc (Zn)-type high-temperature solder such as $Zn_{95}Al_5$ (melting point 380° C.), tin-lead-type standard solder such as $Sn_5Pb_{95}$ (melting point 300-314° C.) and $Sn_2Pb_{98}$ (melting point 316-322° C.), and brazing materials such as $Au_{88}Ga_{12}$ (melting point 381° C.) (All of the above subscripts represent atomic %).

When three members (i.e., the cathode panel, the anode panel and the joining member) are to be joined together, these three members may be joined together at the same time, or either one of the cathode panel and the anode panel may be joined to the joining member at a first stage, and the other of the cathode panel and the anode panel may be joined to the joining member at a second stage. When the simultaneous joining of the three members or the joining at the second stage is performed in a high vacuum atmosphere, the space surrounded by cathode panel, the anode panel and the joining member forms a vacuum at the same time as the joining. Otherwise, after the completion of the joining of the three members, the space surrounded by the cathode panel, the anode panel and the joining member may be evacuated to vacuum. When evacuation is to be performed after the joining, the pressure of the atmosphere during the joining may be either a normal pressure or a reduced pressure. Gas which constitutes the atmosphere is preferably inert gas containing nitrogen gas or gas (for example, Ar gas) belonging to the group 0 of the periodic table, but the joining can also be performed in the air.

Evacuation can be performed through an evacuation tube called a tip tube, which is connected to the cathode panel and/or the anode panel in advance. The evacuation tube is typically formed of a glass tube or a hollow tube formed of metal or alloy having a low coefficient of thermal expansion (for example, an iron (Fe) alloy containing nickel (Ni) 42 weight %, or an iron (Fe) alloy containing nickel (Ni) 42 weight % and chromium (Cr) 6 weight %). The evacuation tube is joined to the periphery of a through-hole section provided in an ineffective area of the cathode panel and/or the anode panel, by the use of the above-mentioned frit glass or low-melting metallic material. After the space reaches a predetermined degree of vacuum, the evacuation tube is sealed by heat melting or by crimping. In addition, it is preferable to temporarily heat the entire flat panel display and then decrease the temperature thereof before the sealing, because the residual gas can be discharged into the space and can be removed from the space by evacuation.

The space sandwiched between the cathode panel and the anode panel is held under high vacuum. Accordingly, if a spacer fabricated from a high-resistance material such as a ceramic material or glass is not arranged between the cathode panel and the anode panel, the flat panel display will be damaged by atmospheric pressure.

The spacer can be formed of, for example, ceramic or glass. If the spacer is formed of a ceramic material, the ceramic material can be selected from among mullite, alumina, barium titanate, lead titanate zirconate, zirconia, codiorite, barium borosilicate, iron silicate, a glass ceramic material, and a material having a composition in which titanium oxide, chromium oxide, iron oxide, vanadium oxide or nickel oxide is added to any of these materials. In this case, the spacer can be manufactured by forming a so-called green sheet, firing the green sheet, and cutting the fired green sheet. In addition, soda-lime glass can be used as glass which constitutes the spacer. The spacer may be fixed in the state of being clamed between adjacent partition walls, or by a spacer holding section which is formed on, for example, the anode panel and/or the cathode panel.

An antistatic film may be provided on the surface of the spacer. A material which constitutes the antistatic film preferably has a secondary electron emission coefficient close to 1, and can be selected from among such as semimetals such as graphite, oxides, borides, carbides, sulfides, nitrides and the like. Typical examples are compounds containing a semimetal such as graphite and a semimetallic element such as $MoSe_2$, oxides such as $CrO_x$, $CrAl_xO_y$, $Nd_2O_3$, $LaxBa_{2-x}CuO_4$, $LaxBa_{2-x}CuO_4$, $La_xY_{1-x}CrO_3$, borides such as $AlB_2$ and $TiB_2$, carbides such as SiC, sulfides such as $MoS_2$ and $WS_2$, and nitrides such as BN, TiN and AlN, and furthermore, it is also possible to use materials described in, for example, National Publication of Translated Version (Tokuhyo) Number 2004-500688. The antistatic film may be made of a single kind of material or a plurality of kinds of materials, and may have a single-layer structure or a multilayer structure. The antistatic film may be formed on the basis of known methods such as a sputtering method, a vacuum evaporation method and a CVD method.

In the flat panel display according to the first aspect and in the method of manufacturing the anode panel for the flat panel display according to the first aspect, the average thickness of the anode electrode peripheral section is smaller than the average thickness of the anode electrode central section. Accordingly, in the heat treatment step of the manufacturing process of the flat panel display, compressive stresses due to the difference in thermal expansion between the anode electrode peripheral section and a flat substrate which serves as the base of the anode electrode peripheral section can be lowered, so that phenomena such as whiskers or hillocks do not easily occur. In addition, if the average thickness of the anode electrode central section is made approximately as small as the average thickness of the anode electrode peripheral section, backscattered electrons such as electrons recoiling from each of the phosphor areas or secondary electrons emitted from each of the phosphor areas are liable to easily pass through the anode electrode central section and enter other phosphor areas, so that it becomes difficult to prevent occurrence of so-called optical crosstalk (color haze). The base of the anode electrode central section is the phosphor areas, the light absorption layer and the partition walls having irregularities. Accordingly, the compressive stresses occurring in the heat treatment step of the manufacturing process of the flat panel display is not particularly high, so that phenomena such as whiskers or hillocks do not easily occur.

In the flat panel display according to the second aspect and in the method of manufacturing the anode panel for the flat panel display according to the second aspect, the anode electrode peripheral section is formed of the second conductive material different from the first conductive material, so that the anode electrode peripheral section can be formed of a conductive material which does not easily cause whiskers or hillocks.

Furthermore, in the flat panel display according to the third aspect and in the method of manufacturing the anode panel for the flat panel display according to each of the third and fourth aspects, the anode electrode is formed of aluminum alloy. Accordingly, in the heat treatment step of the manufacturing process of the flat panel display, since the difference in thermal expansion between the anode electrode peripheral section and the substrate which serves as the base of the anode electrode peripheral section can be reduced, compressive stresses due to the difference in thermal expansion can be lowered, so that phenomena such as whiskers or hillocks do not easily occur.

In the flat panel display according to the fourth aspect and in the method of manufacturing the cathode panel for the flat panel display according to each of the first and second aspects, the focusing electrode is formed of aluminum alloy. Accordingly, in the heat treatment step of the manufacturing process of the flat panel display, since the difference in thermal expansion between the focusing electrode and the underlying base can be reduced, compressive stresses due to the difference in thermal expansion can be lowered, so that phenomena such as whiskers or hillocks do not easily occur.

Accordingly, it is possible to provide flat panel displays which do not easily cause discharge due to applied voltages during actual operation, exhibit superior withstand voltage characteristics and stable operating characteristics, and have high reliability and long life.

Additional features and advantages are described herein, and will be apparent from, the following Detailed Description and the figures.

BRIEF DESCRIPTION OF THE FIGURES

The embodiments will become more readily appreciated and understood from the following detailed description when taken in conjunction with the accompanying drawings.

DETAILED DESCRIPTION

Preferred embodiments are described below with reference to the accompanying drawings. Prior to the description of each embodiment, a concept common to flat panel displays according to the respective preferred embodiments is described. In the following description, all flat panel displays according to the first to seventh embodiments are cold cathode field emission displays (hereinafter referred to simply as the display(s)).

Figure 22:
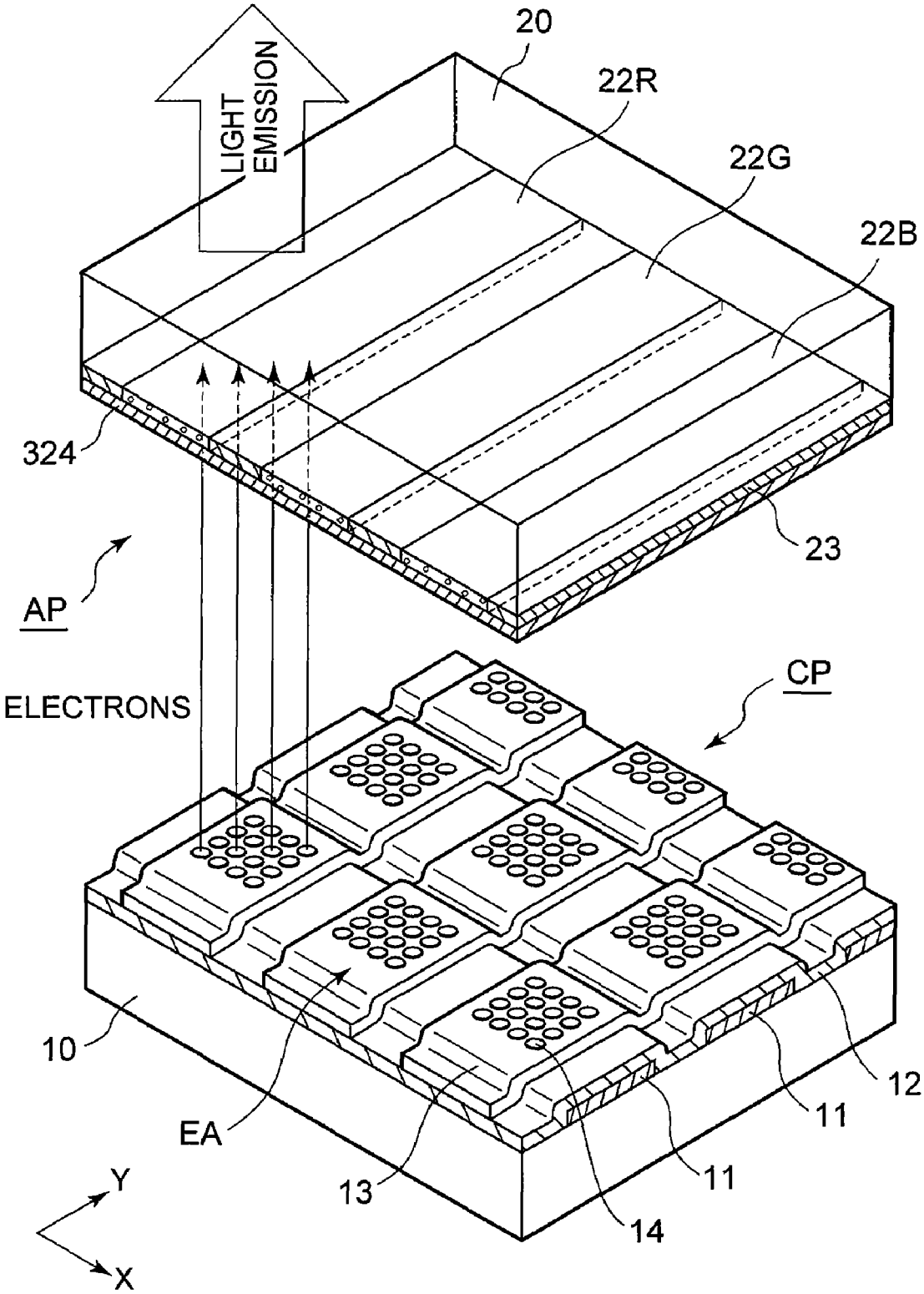
FIG. 22 is a schematic exploded view, in fragmentary perspective, of a cathode panel and an anode panel in a cold cathode field emission display.

The display according to each of the first to seventh embodiments includes a cathode panel CP having a plurality of electron emission areas EA provided on a support 10, and an anode panel AP having a plurality of phosphor areas 22 and an anode electrode 24, 124 or 224, and the cathode panel CP and the anode panel AP are joined together at their periphery by a joining member 26. The display according to each of the first to seventh embodiments has an effective area EF and an ineffective area NE which surrounds the effective area EF. The effective area EF is a display area which is positioned at approximately the center of the display and serves as a practical image display function in the display, and is surrounded by the ineffective area NE which surrounds the effective area EF in a frame-like manner. The space defined between the cathode panel CP and the anode panel AP is held under vacuum (at a pressure not higher than $10^{-3}$ Pa, for example). The plurality of electron emission areas EA are arranged in a two-dimensional matrix on the section of the support 10 that constitutes the effective area EF, and the plurality of phosphor areas 22 are arranged in a two-dimensional matrix on the section of a substrate 20 that constitutes the effective area EF, in such a manner that the respective phosphor areas 22 are opposed to the electron emission areas EA. A partial schematic exploded perspective view of the anode panel AP and the cathode panel CP is basically the same as that shown in FIG. 22.

In each of the first to seventh embodiments, field emitters which constitute each of the electron emission areas EA are respectively made of, for example, Spindt field emitters. A Spindt field emitter includes, as shown in FIG. 1, FIGS. 3 to 5 or FIGS. 7 to 11, (a) a cathode electrode 11 formed on the support 10, (b) an insulation layer 12 formed on the support 10 and the cathode electrode 11, (c) a gate electrode 13 formed on the insulation layer 12, (d) an opening section 14 provided to extend through the gate electrode 13 and the insulation layer 12 (a first opening section 14A provided in the gate electrode 13 and a second opening section 14B provided in the insulation layer 12), and (e) a conical electron emission section 15 formed on the section of the cathode electrode 11 that is positioned at the bottom of the opening section 14.

Figure 21:
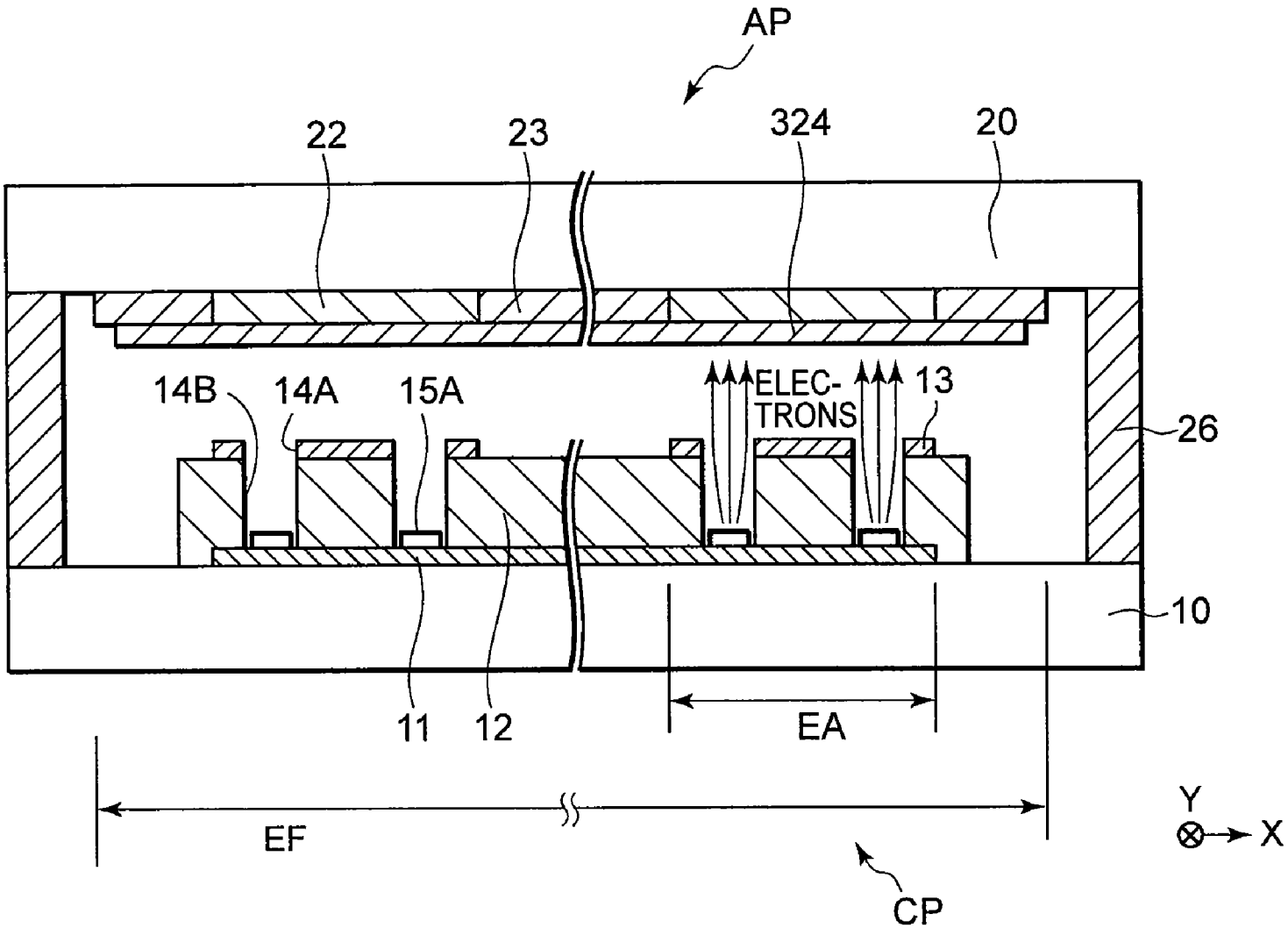
FIG. 21 is a conceptual end view, in fragmentary cross section, of a conventional flat panel display based on a cold cathode field emission display having flat-type cold cathode field emitters.

Otherwise, in each of the first to seventh embodiments, a field emitter is made of, for example, a flat field emitter. A flat field emitter includes, as shown in FIG. 21, (a) the cathode electrode 11 formed on the support 10, (b) the insulation layer 12 formed on the support 10 and the cathode electrode 11, (c) the gate electrode 13 formed on the insulation layer 12, (d) the opening section 14 provided to extend through the gate electrode 13 and the insulation layer 12 (the first opening section 14A provided in the gate electrode 13 and the second opening section 14B provided in the insulation layer 12), and (e) an electron emission section 15A formed on the section of the cathode electrode 11 that is positioned at the bottom of the opening section 14. The electron emission section 15A is made of, for example, a multiplicity of carbon nanotubes partially embedded in the matrix.

In the cathode panel CP, the cathode electrode 11 has a strip-like shape extending in a first direction (refer to the X direction in each of FIGS. 1, 3 to 5, 7 to 11, 21 and 22), while the gate electrode 13 has a strip-like shape extending in a second direction different from the first direction (refer to the Y direction in each of the same figures). The cathode electrode 11 and the gate electrode 13 are respectively formed in the strip-like shapes in the directions in which projected images of the cathode and gate electrodes 11 and 13 are orthogonal to each other. Each of the electron emission areas EA which corresponds to one subpixel is provided with a plurality of field emitters. An interlayer insulation layer 16 is provided over the insulation layer 12 and the gate electrode 13, and a focusing electrode 17 is provided over the interlayer insulation layer 16 along a predetermined arrangement direction of the field emitters so that a common focusing effect can be applied to a plurality of field emitters. In addition, a third opening section 14C is provided in the focusing electrode 17 and the interlayer insulation layer 16.

In each of the first to seventh embodiments, the anode panel AP includes the substrate 20 and the phosphor areas 22 (in the case of color display, red light emitting phosphor areas 22R, green light emitting phosphor areas 22G, and blue light emitting phosphor areas 22B) formed on the substrate 20, as well as the anode electrode 24, 124 or 224. A light absorption layer (a black matrix) 23 is formed on the section of the substrate 20 that is interposed between each of the phosphor areas 22, in order to prevent occurrence of color haze and optical crosstalk in display images. Furthermore, spacers 40 (not shown in all the figures) made of alumina ($Al_2O_3$, purity: 99.8 weight %) are arranged between the cathode panel CP and the anode panel AP.

In the display according to each of the first to seventh embodiments, the cathode electrodes 11 are connected to a cathode electrode control circuit 31, the gate electrodes 13 are connected to a gate electrode control circuit 32, the focusing electrodes 17 are connected to a focusing electrode control circuit (not shown), and an anode electrode central section (24A or 124A) or an anode electrode unit is connected to an anode electrode control circuit 33. These control circuits may be constructed from known circuits. During actual operation of the display, an anode voltage $V_A$ which is applied from the anode electrode control circuit 33 to the anode electrode central section or the anode electrode unit is normally constant and may be, for example, in the range between 5 kilovolts and 15 kilovolts. As to a voltage $V_C$ and a voltage $V_G$ which are respectively applied to each of the cathode electrodes 11 and each of the gate electrodes 13 during actual operation of the display, any of the following methods may be adopted:

(1) the method of fixing the voltage $V_C$ applied to the cathode electrodes 11 and varying the voltage $V_G$ applied to the gate electrodes 13;

(2) the method of varying the voltage $V_C$ applied to the cathode electrodes 11 and fixing the voltage $V_G$ applied to the gate electrodes 13; and (3) the method of varying the voltage $V_C$ applied to the cathode electrodes 11 and also varying the voltage $V_G$ applied to the gate electrodes 13.

During actual operation of the display, a relatively negative voltage ($V_C$) is applied to the cathode electrodes 11 from the cathode electrode control circuit 31, a relatively positive voltage ($V_G$) is applied to the gate electrodes 13 from the gate electrode control circuit 32, a voltage of, for example, 0 volts is applied to the focusing electrodes 17 from the focusing electrode control circuit (not shown), and a positive voltage (the anode voltage $V_A$) higher than that applied to the gate electrodes 13 is applied to the anode electrode central section or the anode electrode unit. When the above-mentioned display is to perform display, a scanning signal is inputted to the cathode electrodes 11 from the cathode electrode control circuit 31, and a video signal is inputted to the gate electrodes 13 from the gate electrode control circuit 32. In addition, the display may be constructed so that a video signal is inputted to the cathode electrodes 11 from the cathode electrode control circuit 31 and a scanning signal is inputted to the gate electrodes 13 from the gate electrode control circuit 32. Electrons are emitted from the electron emission sections 15 or 15A on the basis of a quantum tunneling effect owing to electric fields produced when voltage is applied across each of the cathode electrodes 11 and each of the gate electrodes 13, and the electrons are attracted to the anode electrode central section or the anode electrode unit, so that the phosphor areas 22 are excited to emit light, thereby obtaining a desired image. Namely, the operation of the display is basically controlled by the voltage $V_G$ applied to the gate electrodes 13 and the voltage $V_C$ applied to the cathode electrodes 11.

Embodiment 1

The first embodiment is described below.

The first embodiment relates to a flat panel display according to the first and fourth aspects, a method of manufacturing an anode panel for the flat panel display according to the first aspect, and a method of manufacturing a cathode panel for the flat panel display according to the second aspect.

Figure 1:
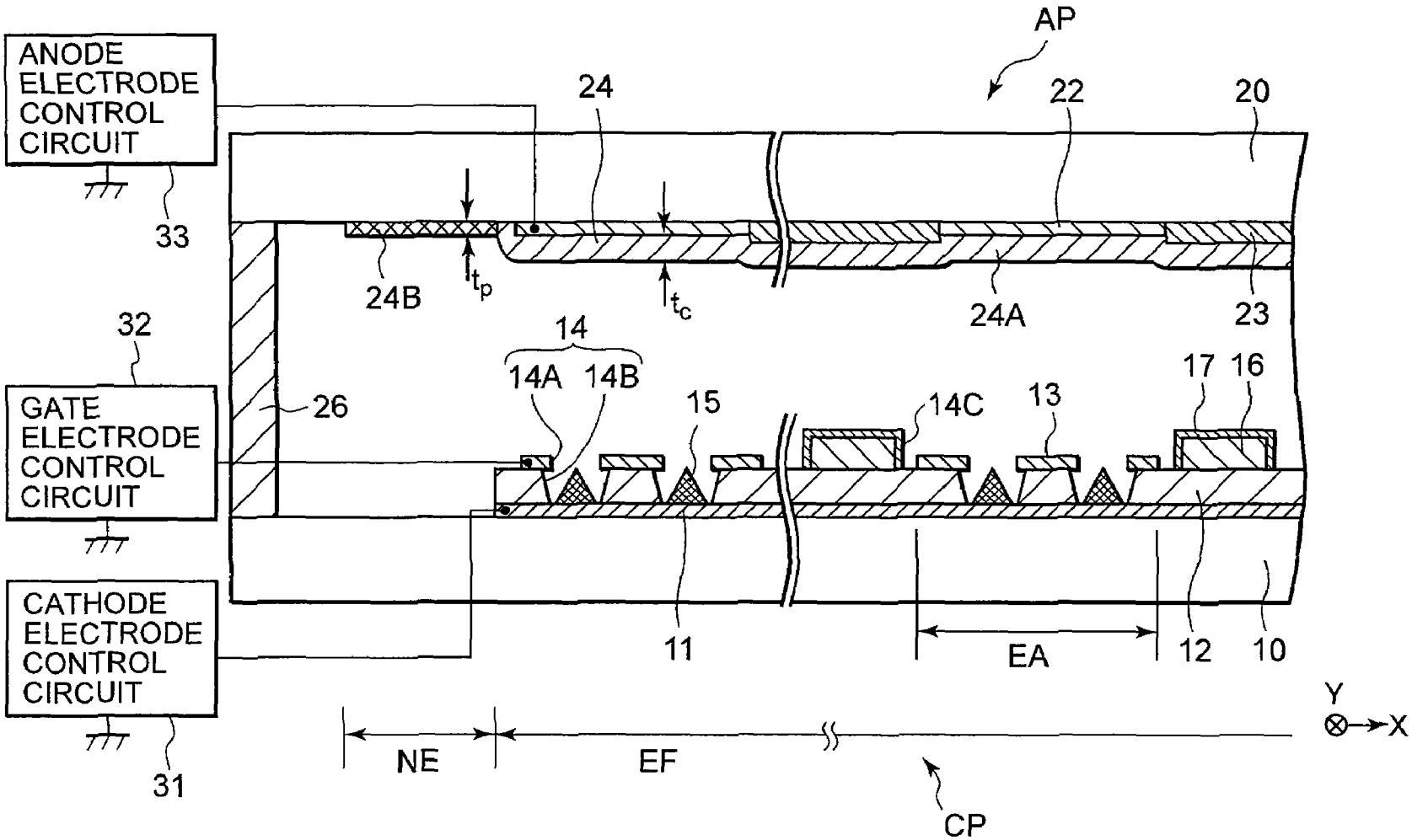
FIG. 1 is a schematic end view, in fragmentary cross section, of a display according to a first embodiment provided with Spindt-type cold cathode field emitters.
Figure 2A:
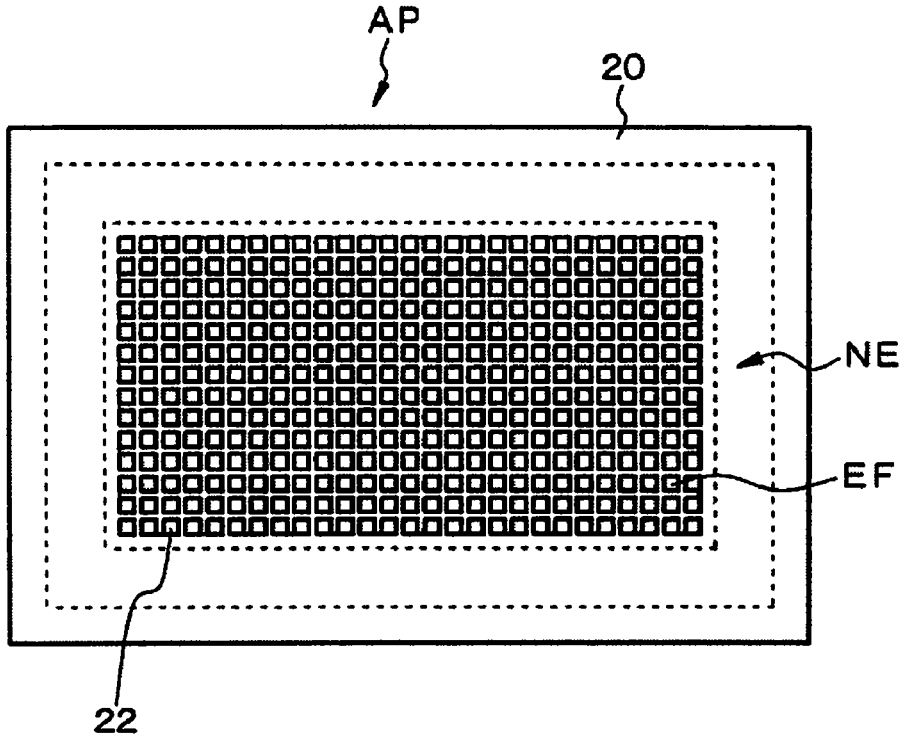
FIGS. 2A and 2B are conceptual diagrams showing the state of arrangement of constituent elements of an anode panel in the display according to the first embodiment.
Figure 2B:
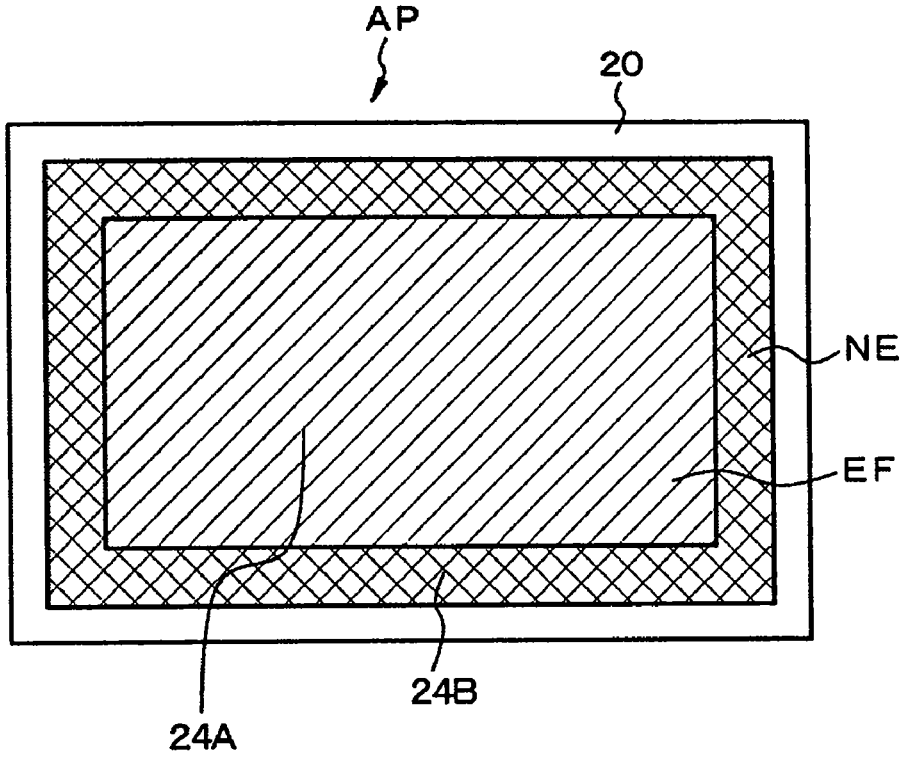

FIG. 1 shows a schematic end view, in fragmentary cross section, of the display according to the first embodiment, and FIGS. 2A and 2B show conceptual diagrams showing the state of arrangement of constituent elements of the anode panel in the display according to the first embodiment. FIG. 2A (as well as FIG. 6A which will be mentioned later) schematically shows the state of arrangement of the phosphor areas 22 with the anode electrode 24 and others being omitted, and FIG. 2B (as well as FIG. 6B which will be mentioned later) shows a conceptual diagram of the state of arrangement of the anode electrode 24 and others with the phosphor areas 22 being covered.

In the first embodiment, the anode electrode 24 includes the anode electrode central section 24A which covers the phosphor areas 22, and an anode electrode peripheral section 24B which surrounds the anode electrode central section 24A and extends therefrom and is provided in contact with the substrate 20. The anode electrode central section 24A is formed on the section of the substrate 20 that constitutes the effective area EF, and the anode electrode peripheral section 24B is formed on the section of the substrate 20 that constitutes the ineffective area NE. An average thickness $t_P$ of the anode electrode peripheral section 24B is smaller than an average thickness $t_C$ of the anode electrode central section 24A. Specifically, the average thickness $t_P$ of the anode electrode peripheral section 24B is 0.1 μm, and the average thickness $t_C$ of the anode electrode central section 24A is 0.3 μm.

That is to say, $t_P/t_C$=0.33. The anode electrode 24 (the anode electrode central section 24A and the anode electrode peripheral section 24B) is made of aluminum (Al). In addition, the anode electrode 24 (the anode electrode central section 24A and the anode electrode peripheral section 24B) may be formed of aluminum alloy (for example, Al—Cr alloy (Cr content: 20 weight %)).

The section of each of the electron emission areas EA that is opposed to the anode panel AP is defined by the focusing electrode 17, and the focusing electrode 17 is made of aluminum alloy of thickness 0.4 μm (for example, Al—Cr alloy (Cr content: 20 weight %)) and serves to restrain occurrence of whiskers and/or hillocks which may cause discharge from the focusing electrode 17.

A method of manufacturing the display according to the first embodiment is described below with reference to FIGS. 18A, 18B, 19A and 19B each of which is a schematic end view showing the support 10 and others in fragmentary cross sections.

First, for example, a Spindt field emitter is manufactured. The Spindt field emitter can be basically obtained by a method of forming the conical electron emission section 15 by vertical evaporation of a metallic material. Namely, evaporated particles vertically enter the first opening section 14A provided in the gate electrode 13, and the quantity of evaporated particles to reach the bottom of the second opening section 14B is gradually decreased by using the shielding effect of an overhang-shaped deposit formed near the opening end of the third opening section 14C, thereby forming the electron emission section 15 as a conical deposit in a self-aligned manner. In the following description, reference will be made to a method of forming a peel layer 18 over the focusing electrode 17 and over the gate electrode 13 and the insulation layer 12 in advance in order to facilitate removal of an unnecessary overhang-shaped deposit. For convenience of explanation, only one field emitter is shown in each of FIGS. 18A, 18B, 19A and 19B aiding in explaining a field emitter manufacturing method.

[Step-C-100]

Specifically, first, a cathode-electrode conductive material layer made of, for example, polysilicon is deposited on the support 10 made of, for example, a glass substrate, by a plasma CVD method. Then, the cathode-electrode conductive material layer is patterned on the basis of lithography techniques and dry etching techniques, to form the cathode electrode 11 of strip-like shape. After that, the insulation layer 12 made of $SiO_2$ is formed on the entire surface of the cathode electrode 11 by a CVD method.

[Step-C-110]

Then, a gate-electrode conductive material layer (for example, a chromium layer) is deposited on the insulation layer 12 by a sputtering method, and is then patterned by a lithography technique and a dry etching technique, so that the gate electrode 13 made of chromium (Cr) and having a strip-like shape can be obtained. The cathode electrode 11 of strip-like shape extends in a lateral direction with respect to the sheet surface of each of the figures, while the gate electrode 13 of strip-like shape extends in a direction perpendicular to the sheet surface of each of the figures.

The gate electrode 13 may be formed as needed by a combination of an etching technique and a known thin film forming method, for example, a vacuum evaporation method such as a PVD method or a CVD method, a plating method such as an electrical plating method or an electroless plating method, a screen printing method, a laser abrasion method, a sol-gel method, or a lift-off method. According to a screen printing method and a plating method, it is possible to directly form, for example, gate electrodes of strip-like shape.

[Step-C-120]

Figure 18A:
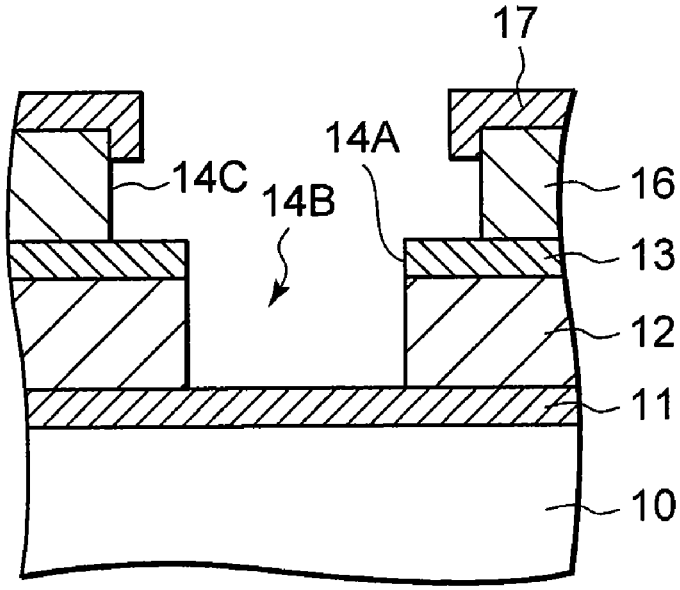
FIGS. 18A and 18B are schematic end views, in fragmentary cross section, of a support and others, aiding in explaining a method of manufacturing a Spindt-type cold cathode field emitter.
Figure 18B:
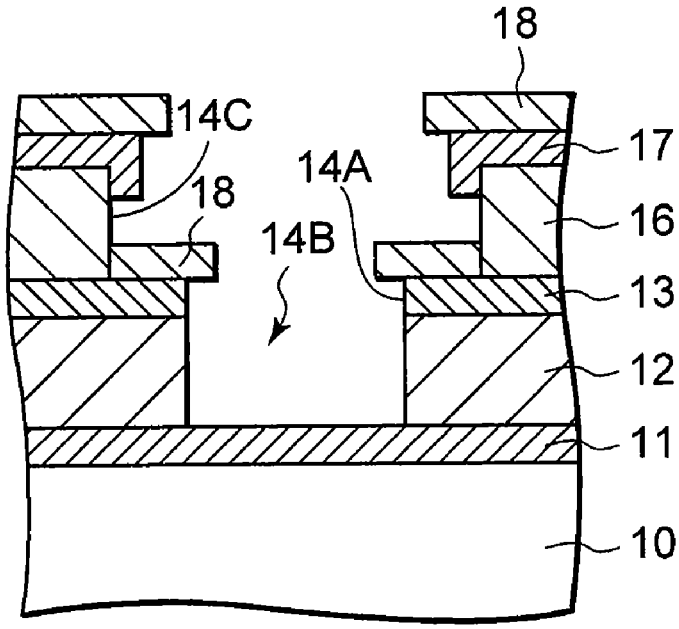

Then, the focusing electrode 17 made of aluminum alloy is formed so as to restrain occurrence of whiskers and/or hillocks which may cause discharge at the focusing electrode 17. Specifically, the interlayer insulation layer 16 made of polyimide resin is provided over the gate electrode 13 and the insulation layer 12, and the focusing electrode 17 is provided over the interlayer insulation layer 16. More specifically, for example, a photosensitive polyimide resin is formed on the entire surface of the gate electrode 13, and the photosensitive polyimide resin is exposed, developed and fired, thereby forming the interlayer insulation layer 16 in which the third opening section 14C is provided. After that, while the support 10 is being rotated, the focusing electrode 17 made of aluminum alloy (for example, Al—Cr alloy) is formed over the interlayer insulation layer 16 by an oblique vacuum evaporation method. The focusing electrode 17 is extended to the top section of the side surface of the third opening section 14C. Then, a resist layer is provided and the first opening section 14A is formed in the gate electrode 13 by etching, and furthermore, the second opening section 14B is formed in the insulation layer 12. After the cathode electrode 11 has been exposed at the bottom of the second opening section 14B, the resist layer is removed. Thus, the structure shown in FIG. 18A is obtained.

[Step-C-130]

Then, while the support 10 is being rotated, nickel (Ni) is obliquely evaporated under vacuum to form the peel layer 18 (refer to FIG. 18B) over the gate electrode 13 and the insulation layer 12 and over the focusing electrode 17. At this time, if the angle of entrance of evaporated particles with respect to the normal to the support 10 is chosen to be sufficiently large (for example, in the range of entrance angles between 65 degrees and 85 degrees), the peel layer 18 can be formed over the focusing electrode 17 and over the gate electrode 13 and the insulation layer 12 with nickel being hardly deposited on the bottom of the second opening section 14B. The peel layer 18 projects in an eaves-like shape from the opening edge of the first opening section 14A, so that the first opening section 14A is substantially reduced in diameter.

[Step-C-140]

Figure 19A:
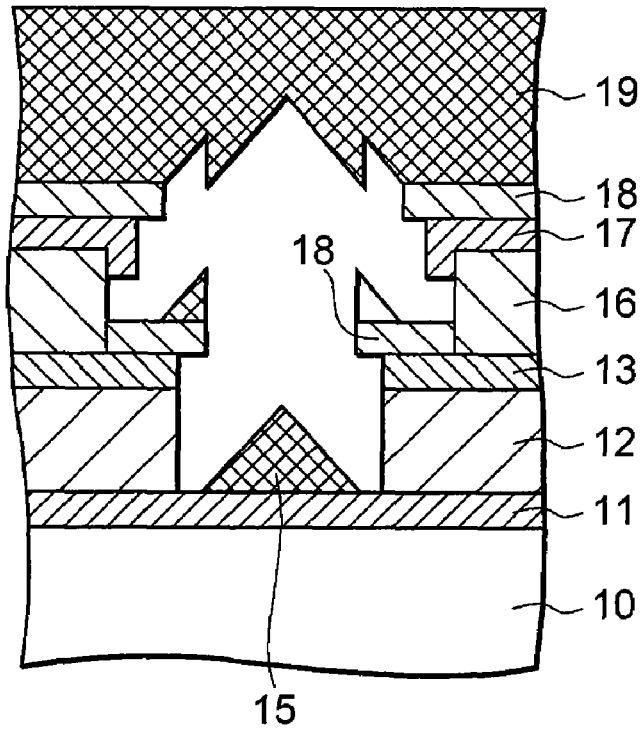
FIGS. 19A, and 19B are schematic end views, in fragmentary cross section, of a support and others, aiding in explaining the method of manufacturing the Spindt-type cold cathode field emitter.

Then, a conductive material, for example, molybdenum (Mo) is vertically evaporated onto the entire surface (within the range of entrance angles between 3 degrees and 10 degrees with respect to the normal to the support 10). At this time, as shown in FIG. 19A, as a conductive material layer 19 having an overhang-like shape grows on the peel layer 18, the substantial diameter of the first opening section 14A is gradually reduced, so that evaporated particles which contribute to deposition at the bottom of the second opening section 14B are gradually restricted to evaporated particles which pass through near the center of the first opening section 14A. Consequently, a conical deposit is formed at the bottom of the second opening section 14B, and this conical deposit forms the electron emission section 15.

[Step-C-150]

Then, the peel layer 18 is peeled from the surface of the focusing electrode 17 and from the surface of the gate electrode 13 and the insulation layer 12 by a lift-off method, thereby selectively removing the conductive material layer 19 over the focusing electrode 17 and over the gate electrode 13 and the insulation layer 12. Then, the side wall surface of the second opening section 14B provided in the insulation layer 12 is preferably receded by isotropic etching from the viewpoint of exposure of the opening edge of the gate electrode 13.

Figure 19B:
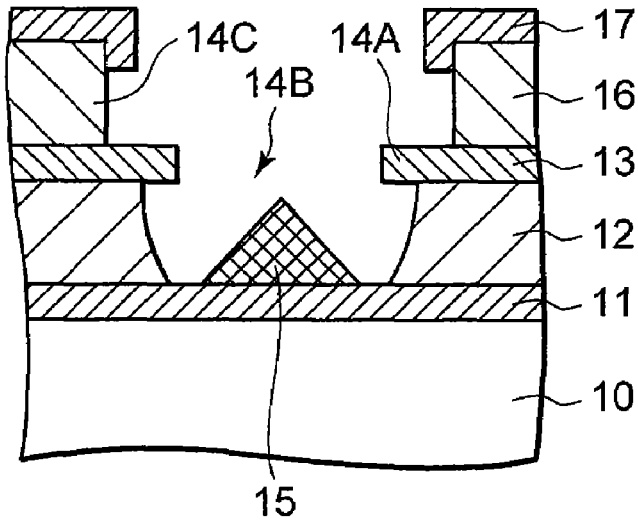
Figure 20:
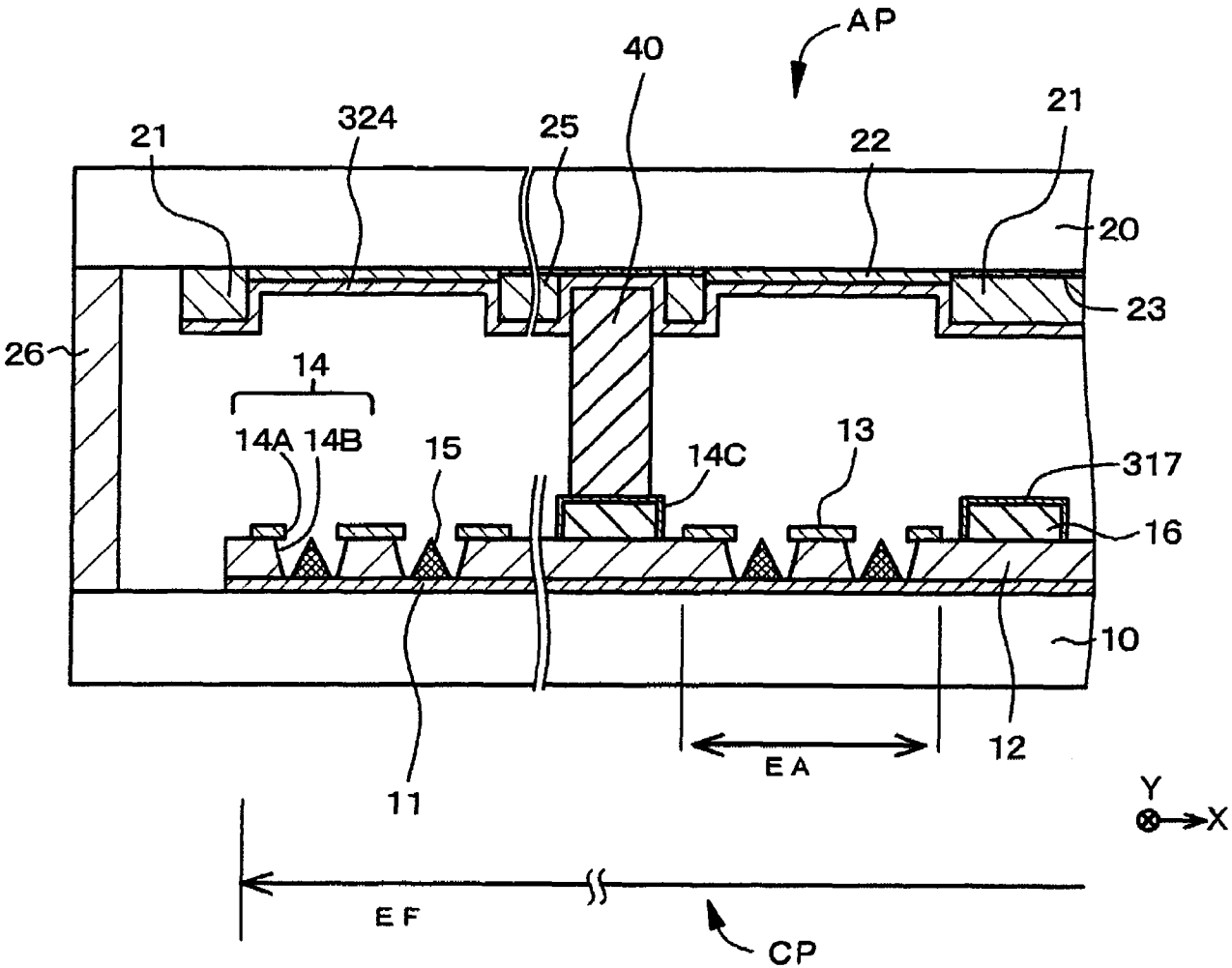
FIG. 20 is a schematic end view, in fragmentary cross section, of a conventional flat panel display based on a cold cathode field emission display having Spindt-type cold cathode field emitters.

Isotropic etching can be effected by dry etching using a radical as its main etching seed as in the case of chemical dry etching, or by wet etching using an etchant. The etchant can use, for example, a 1:100 (volume ratio) mixture of a 49% hydrofluoric acid solution and pure water. Thus, a Spindt field emitter having the structure shown in FIG. 19B is obtained.

In this manner, the cathode panel CP including a plurality of field emitters formed on the support 10 can be obtained.

The anode panel AP is fabricated on the basis of a method that is described below.

[Step-A-100]

First, the light absorption layer (black matrix) 23 made from a grating of chromium oxide is formed on the substrate 20.

[Step-A-110]

Then, the phosphor areas 22 are formed on the exposed surface sections of the substrate 20 each of which is surrounded by the light absorption layer 23. Specifically, when the red light emitting phosphor areas 22R are to be formed, red light emitting phosphor particles are dispersed in, for example, polyvinyl alcohol resin (PVA) and water on the exposed surface sections, and a red light emitting phosphor slurry to which ammonium dichromate is added is applied across the entire surface of each of the exposed surface sections, and subsequently, the red light emitting phosphor slurry is dried. Then, the sections of the red light emitting phosphor slurry in which the respective red light emitting phosphor areas 22R are to be formed are irradiated with ultraviolet rays from the side on which the substrate 20 is located, thereby exposing the red light emitting phosphor slurry. The red light emitting phosphor slurry gradually cures from the side closest to the substrate 20. The thickness of each of the red light emitting phosphor areas 22R is determined by the amount of irradiation of ultraviolet rays onto the red light emitting phosphor slurry. In the first embodiment, the time of irradiation of ultraviolet rays onto the red light emitting phosphor slurry is adjusted to set the thickness of each of the red light emitting phosphor areas 22R to, for example, approximately 8 μm. After that, by developing the red light emitting phosphor slurry, the respective red light emitting phosphor areas 22R can be formed in predetermined areas. Subsequently, the green light emitting phosphor areas 22G are formed by performing a similar process on a green light emitting phosphor slurry, and the blue light emitting phosphor areas 22B are formed by performing a similar process on a blue light emitting phosphor slurry. The above-mentioned method of forming phosphor areas is not limitative, and each phosphor area may be formed by sequentially applying a red light emitting phosphor slurry, a green light emitting phosphor slurry and a blue light emitting phosphor slurry and sequentially performing exposure and development of each of the phosphor slurries, or each phosphor area may also be formed by a screen printing method or the like.

[Step-A-120]

After that, a resin layer is formed on the entire surface. Specifically, a resin layer can be formed on the basis of a metal mask printing method or a screen printing method. Then, the resin layer is dried. Namely, the substrate 20 is loaded into a drying furnace and is dried at a predetermined temperature. The drying temperature of the resin layer is preferably maintained in the range between, for example, 50° C. and 90° C., and the drying time of the resin layer is preferably maintained in the range between, for example, several minutes and several tens of minutes. As a matter of course, the drying time increases and decreases with variations in the drying temperature.

Otherwise, the resin layer can also be formed by a method which will be described below. Namely, the substrate 20 on which the phosphor areas 22 are formed is immersed into a solution (specifically, water) stored in a treatment tank in such a manner that the phosphor areas 22 face the surface of the solution. At this time, the discharge section of the treatment tank is in a closed state. Thus, a resin layer having a substantially flat surface is formed on the surface of the solution. Specifically, an organic solvent in which a resin (lacquer) to construct the resin layer is dissolved is dropped onto the surface of the solution. Namely, a resin layer material to form the resin layer is expanded on the surface of the solution. The resin (lacquer) to construct the resin layer is made of a kind of varnish in a broad sense, that is to say, a material in which a mixture generally containing a cellulose derivative, such as nitro cellulose, as its chief ingredient is dissolved in a volatile solvent such as lower fatty acid ester, or an urethane lacquer or an acrylic lacquer using another kind of synthetic polymer. Then, the resin layer material is dried for, for example, approximately two minutes in the state of floating on the surface of the solution. In this manner, the resin material is formed as a layer, and the resin layer is formed in a flat shape on the surface of the solution. During the formation of the resin layer, the amount of expansion of the resin layer material is adjusted so that the thickness of the resin layer becomes, for example, approximately 30 nm. Subsequently, the discharge section of the treatment tank is opened to discharge the solution from the treatment tank and cause the surface of the solution to descend, so that the resin layer formed on the surface of the solution moves toward the substrate 20 and comes into contact with the phosphor areas 22 and the light absorption layer 23. Thus, the resin layer is finally left on the phosphor areas 22 and the light absorption layer 23.

After the phosphor areas 22 have been formed on the substrate 20 in the above-mentioned manner, the anode electrode 24 which includes the anode electrode central section 24A covering the phosphor areas 22 and the anode electrode peripheral section 24B surrounding the anode electrode central section 24A and extending from the anode electrode central section 24A is formed on the basis of a method which is described below.

[Step-A-130]

Namely, then, a conductive material layer is formed in the effective area EF. Specifically, a conductive material layer made of, for example, aluminum (Al) is formed so as to cover the resin layer by a PVD method such as a vacuum evaporation method or a sputtering method by means of a mask having a pattern corresponding to the anode electrode central section 24A. The average thickness of the conductive material layer is $t_C$.

[Step-A-140]

Then, the resin layer is removed by heat treatment. Specifically, the resin layer is fired at approximately 400° C. The resin layer is combusted and removed by this firing treatment, so that the conductive material layer (the anode electrode central section 24A) made of aluminum (Al) is left on the phosphor areas 22 and the light absorption layer 23. In addition, gases produced by the combustion of the resin layer are discharged through, for example, minute holes formed in the conductive material layer. These holes are so minute as not to seriously affect the structural strength and the image display characteristics of the anode electrode central section 24A.

[Step-A-150]

After that, the anode electrode peripheral section 24B is formed in the ineffective area NE. Specifically, the anode electrode peripheral section 24B made of, for example, aluminum (Al) is formed on the substrate 20 by a PVD method such as a vacuum evaporation method or a sputtering method by means of a mask having a pattern corresponding to the anode electrode peripheral section 24B. The average thickness of the anode electrode peripheral section 24B is $t_P$.

The anode panel AP can be completed by the above-mentioned steps.

In addition, the anode electrode peripheral section 24B may be first formed and then the anode electrode central section 24A may be formed. Otherwise, the lower layer section of the anode electrode central section 24A and the anode electrode peripheral section 24B may be first formed at the same time and then the upper layer section of the anode electrode central section 24A may be formed.

[Step-A-160]

Then, assembly of the display is carried out. Specifically, for example, a spacer (not show) is attached to a spacer holding section (not shown) provided in the effective area EF of the anode panel AP, and the anode panel AP and the cathode panel CP are arranged so that the respective phosphor areas 22 are opposed to the electron emission areas EA, and the anode panel AP and the cathode panel CP (more specifically, the substrate 20 and the support 10) are joined together at their periphery by the joining member 26 which is made of an approximately 2 mm high frame fabricated from ceramic or glass and an adhesive layer made of frit glass. During joining, the adhesive layer may be fired, for example, at approximately 400° C. for 10 to 30 minutes in a nitrogen gas atmosphere. After that, a space which is surrounded by the anode panel AP, the cathode panel CP and the joining member 26 is evacuated through a through-hole (not shown) and an evacuation pipe (not shown), and the evacuation pipe is sealed by heat melting at the time when the pressure of the space reaches approximately $10^{-4}$ Pa. In this manner, the space surrounded by the anode panel AP, the cathode panel CP and the joining member 26 can be evacuated to vacuum. Otherwise, the sticking of the joining member 26, the anode panel AP and the cathode panel CP may be carried out in a high vacuum atmosphere. In addition, according to the structure of the display, the anode panel AP and the cathode panel CP may be stuck to each other by a joining member made of an adhesive layer without a frame. After that, wiring to necessary external circuits is performed to complete the display.

In the first embodiment, the anode electrode 24 is made of the anode electrode central section 24A of thickness $t_C$ and the anode electrode peripheral section 24B of thickness $t_P$, so that when the adhesive layer is fired at approximately 400° C. for 10 to 30 minutes in [Step-A-160], a kind of projection such as whiskers or hillocks is not formed in the anode electrode peripheral section 24B. In addition, a kind of projection such as whiskers or hillocks is not formed in the anode electrode central section 24A, either.

The base of the anode electrode peripheral section 24B is a flat substrate 20, and the base of the anode electrode central section 24A is the phosphor areas 22 and the light absorption layer 23 having irregularities. In the case where the thickness of the anode electrode peripheral section 24B is made approximately equal to that of the anode electrode central section 24A, when the adhesive layer is fired at approximately 400° C. for 10 to 30 minutes in [Step-A-160], a compressive stress due to the difference in thermal expansion between the anode electrode peripheral section 24B and the substrate 20 occurs in the anode electrode peripheral section 24B, so that whiskers or hillocks are formed. However, in the first embodiment, since the average thickness $t_P$ of the anode electrode peripheral section 24B is smaller than the average thickness $t_C$ of the anode electrode central section 24A, when the adhesive layer is fired at approximately 400° C. for 10 to 30 minutes in [Step-A-160], the compressive stress due to the difference in thermal expansion between the anode electrode peripheral section 24B and the flat substrate 20 which serves as the base of the anode electrode peripheral section 24B can be lowered, so that phenomena such as whiskers or hillocks do not easily occur. In addition, since the average thickness of the anode electrode central section 24A is sufficiently large, backscattered electrons such as electrons recoiling from each of the phosphor areas 22 or secondary electrons emitted from each of the phosphor areas 22 do not easily pass through the anode electrode central section 24A, so that the backscattered electrons can be prevented from entering other phosphor areas and causing so-called optical crosstalk (color haze). In addition, since the base of the anode electrode central section 24A is the phosphor areas 22 and the light absorption layer 23 having irregularities, the compressive stress occurring in [Step-A-160] is not particularly high, so that phenomena such as whiskers or hillocks do not easily occur.

For comparison, a display was fabricated in which the anode electrode 24 was made of the anode electrode central section 24A and the anode electrode peripheral section 24B each made of aluminum (Al) of the same thickness ($t_C$). During the fabrication of the comparative display, when the adhesive layer was fired at approximately 400° C. for 10 to 30 minutes in [Step-A-160], a large number of projections such as whiskers or hillocks were formed in the anode electrode peripheral section 24B.

The relationship between the thickness of an aluminum layer and the formation of projections such as whiskers or hillocks was more accurately examined. Specifically, a Cr layer of thickness 0.16 μm was deposited on a glass substrate, and an aluminum layer was formed on the Cr layer by a sputtering method. Two kinds of aluminum layers of different thicknesses 0.4 μm and 0.1 μm were prepared. Each of these test substrates was subjected to heat treatment at 350° C. for 4 hours in a vacuum atmosphere, and the number and the length of whiskers which were formed in the aluminum layer were measured. The measured result of the number of the whiskers and the measured result of the length of the whiskers are shown in Table 1. As can be seen from Table 1, the aluminum layer of thickness 0.1 μm formed whiskers fewer in number and shorter in length than did the aluminum layer of thickness 0.4 μm.

TABLE 1

| Average Thickness of Aluminum Layer | Number of Whiskers | Average Length of Whiskers |
|---|---|---|
| 0.1 μm | 1.2 | 57.5 μm |
| 0.4 μm | 31.5 | 97.3 μm |

In addition, in the first embodiment, since the focusing electrode 17 is made of aluminum alloy, when the adhesive layer is fired at approximately 400° C. for 10 to 30 minutes in [Step-A-160], the difference in thermal expansion between the focusing electrode 17 and the interlayer insulation layer 16 which serves as the base of the focusing electrode 17 can be lowered and compressive stresses due to the difference in thermal expansion can be lowered, so that phenomena such as whiskers or hillocks do not occur. In addition, similar results were obtained in the second to sixth embodiments described below.

For comparison, a display was fabricated in which the focusing electrode 17 was made of aluminum (Al). During the fabrication of the comparative display, when the adhesive layer was fired at approximately 400° C. for 10 to 30 minutes in [Step-A-160], a large number of projections such as whiskers or hillocks were formed in the focusing electrode 17.

Embodiment 2

The second embodiment is described below.

The second embodiment is a modification of the first embodiment. In the anode panel AP of the second embodiment, grate-shaped partition walls 21 which surround the phosphor areas 22 are formed on the substrate 20.

Figure 3:
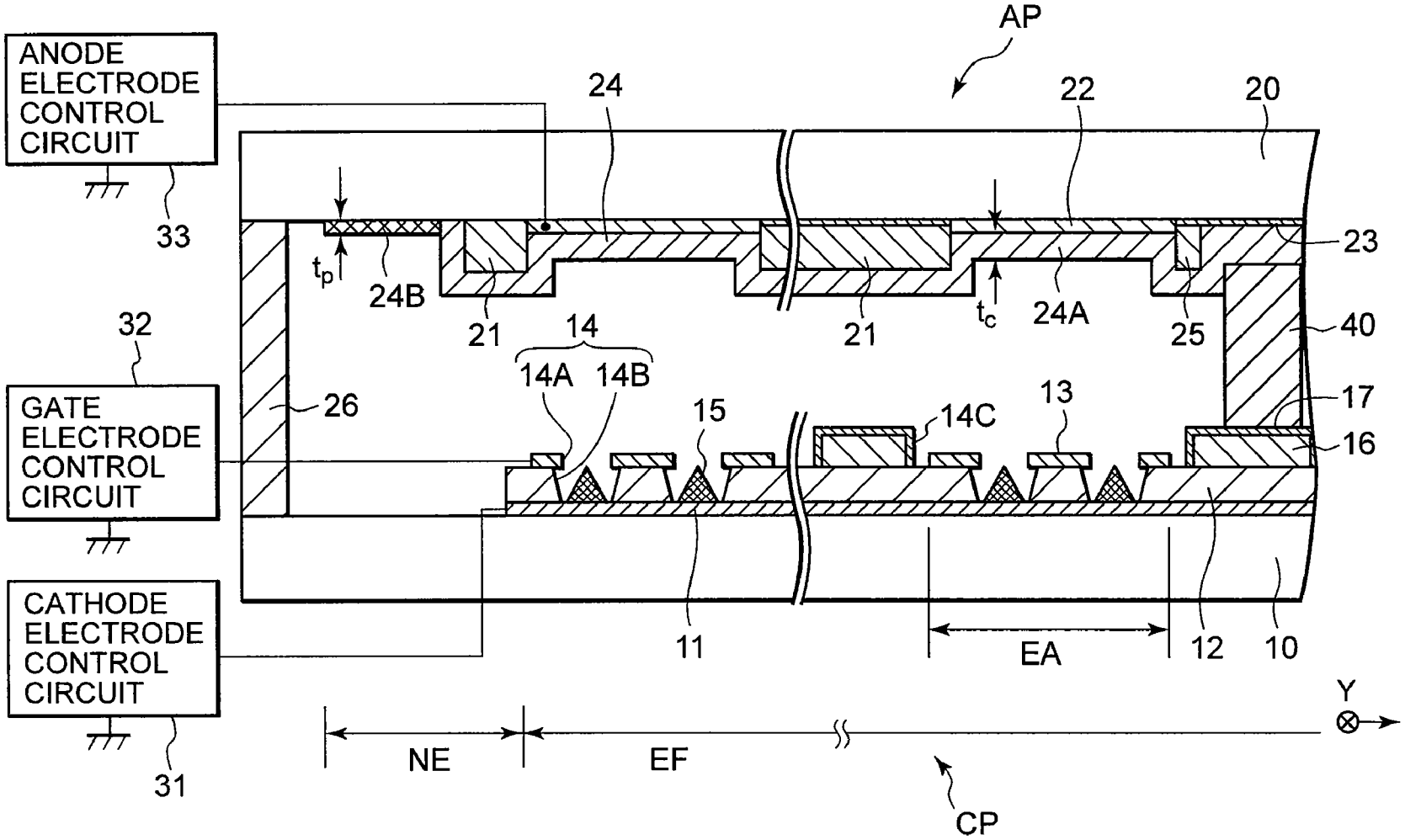
FIG. 3 is a schematic end view, in fragmentary cross section, of a display according to a second embodiment provided with Spindt-type cold cathode field emitters.

In the second embodiment as well, one pixel is formed by the red light emitting phosphor areas 22R, the green light emitting phosphor areas 22G and the blue light emitting phosphor areas 22B, and one subpixel is formed by each of the phosphor areas 22. As shown in FIG. 3 which is a schematic end view, in fragmentary cross section, of the display according to the second embodiment, the second embodiment differs from the first embodiment in that the phosphor areas 22 are surrounded by the partition walls 21. The planar shapes of the sections of the grate-shaped partition walls 21 that surround the respective phosphor areas 22 are rectangular shapes (each of the planar shapes corresponds to the inner contour of a projected image of the side surfaces of a respective one of the partition walls, and is a kind of opening area), and these planar shapes (the planar shapes of the respective opening areas) are arranged in a two-dimensional matrix (more specifically, in a parallel cross shape). In this manner, the grate-shaped partition walls 21 are formed. In addition, reference numeral 40 denotes a spacer, and reference numeral 25 denotes a spacer holding section formed by one of the partition walls 21.

Figure 13:
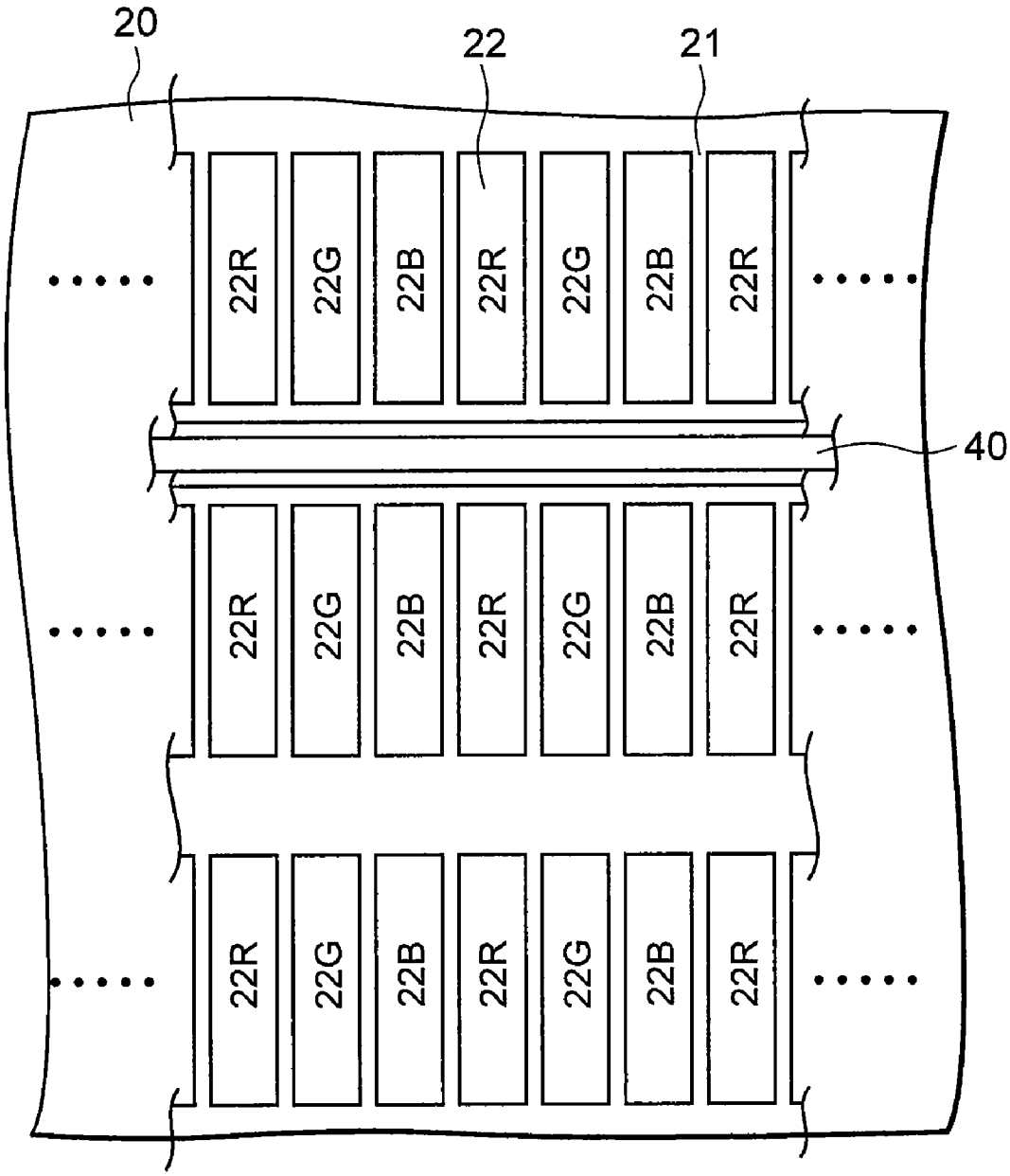
FIG. 13 is an arrangement diagram schematically showing the arrangement of partition walls, spacers and phosphor areas in an anode panel which constitutes a flat panel display.
Figure 14:
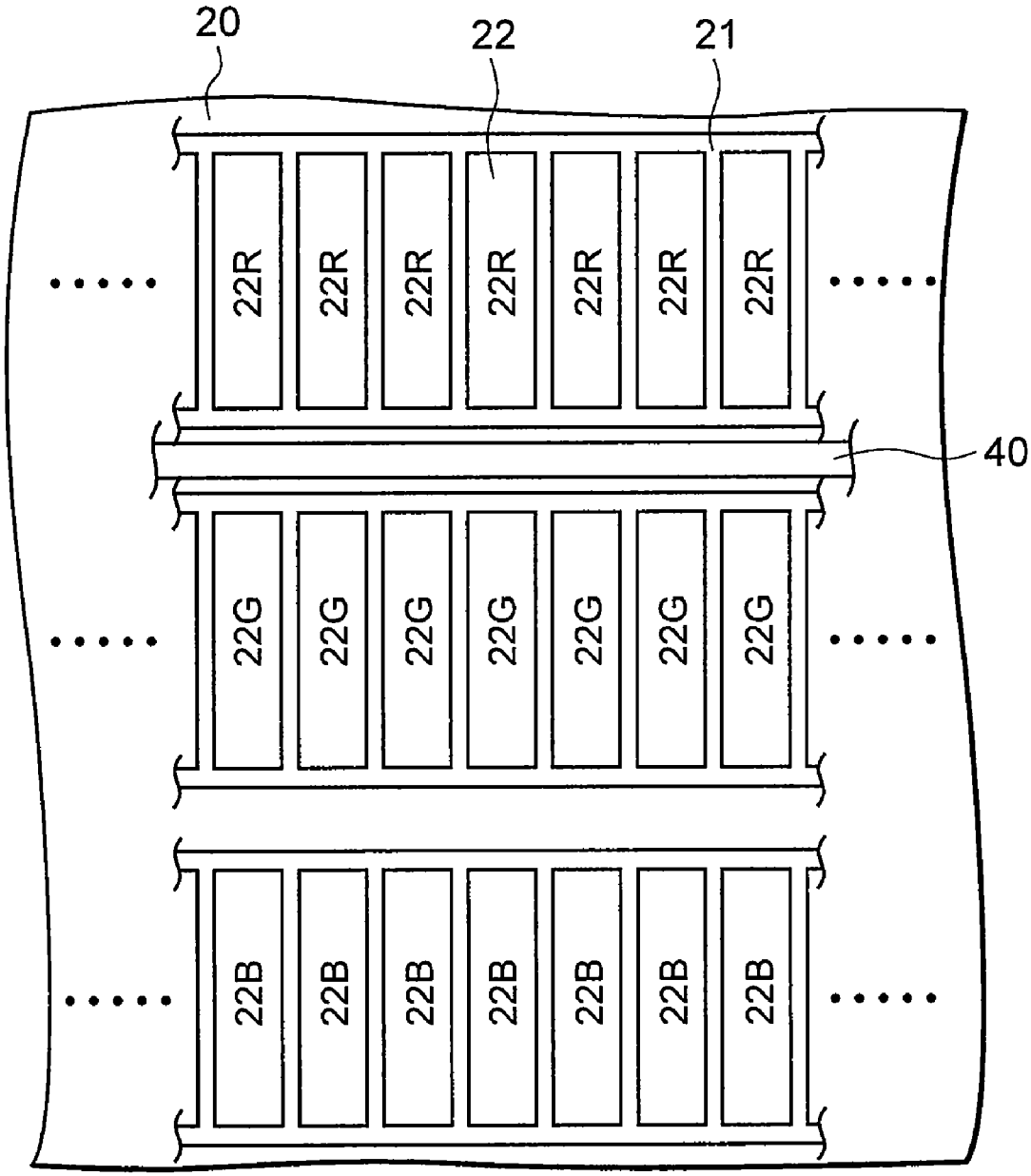
FIG. 14 is an arrangement diagram schematically showing the arrangement of partition walls, spacers and phosphor areas in an anode panel which constitutes a flat panel display.
Figure 15:
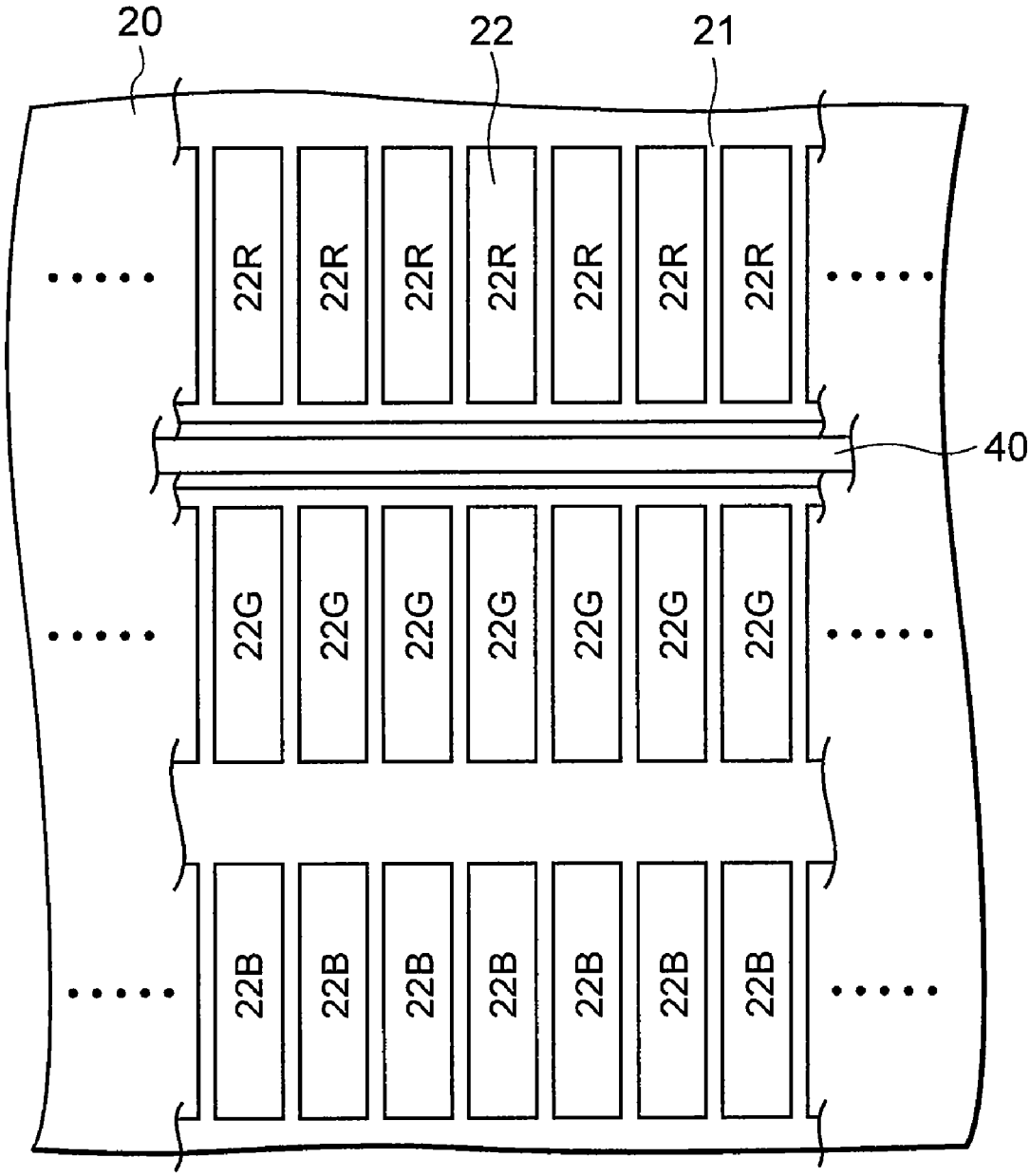
FIG. 15 is an arrangement diagram schematically showing the arrangement of partition walls, spacers and phosphor areas in an anode panel which constitutes a flat panel display.
Figure 16:
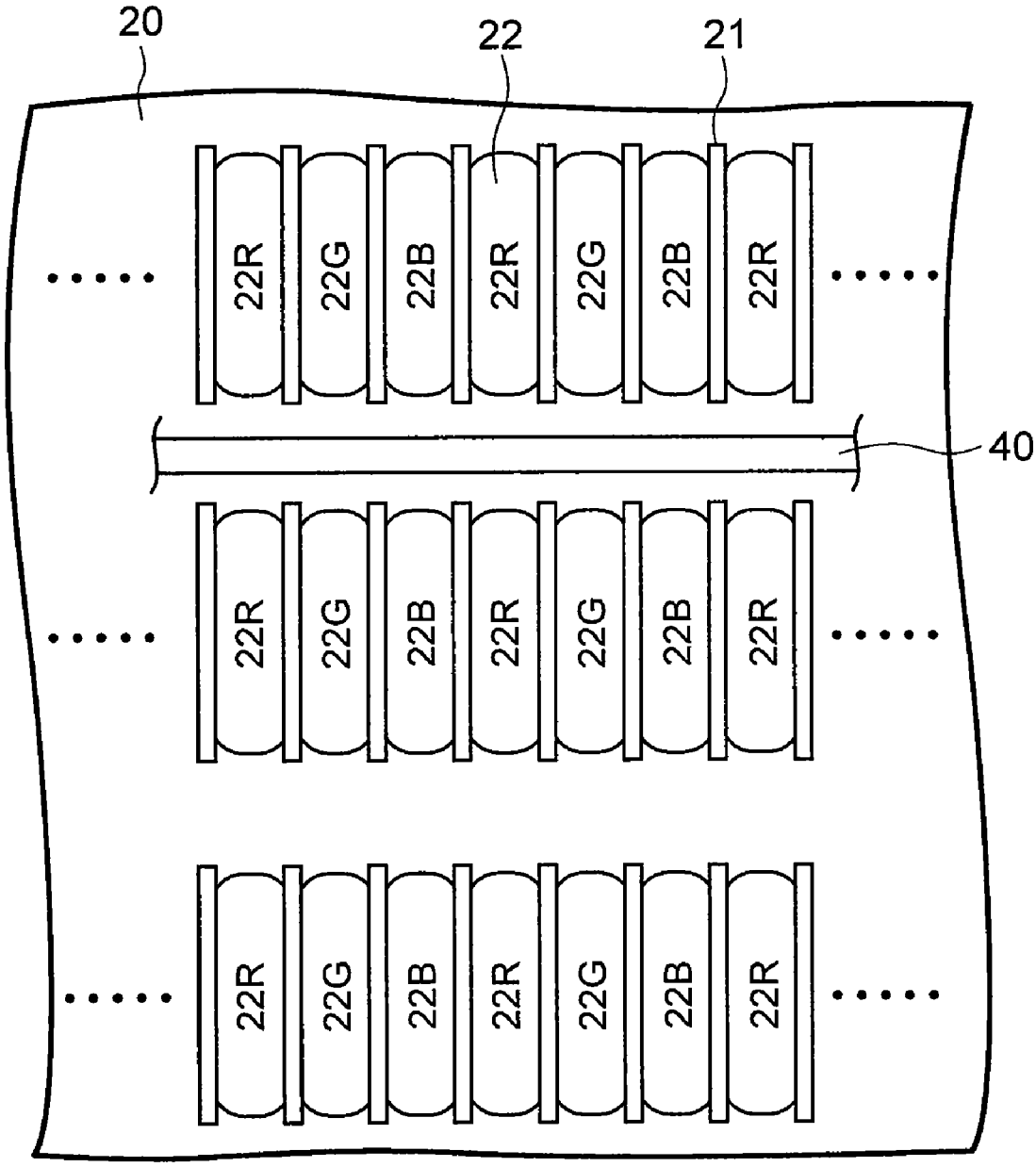
FIG. 16 is an arrangement diagram schematically showing the arrangement of partition walls, spacers and phosphor areas in an anode panel which constitutes a flat panel display.
Figure 17:
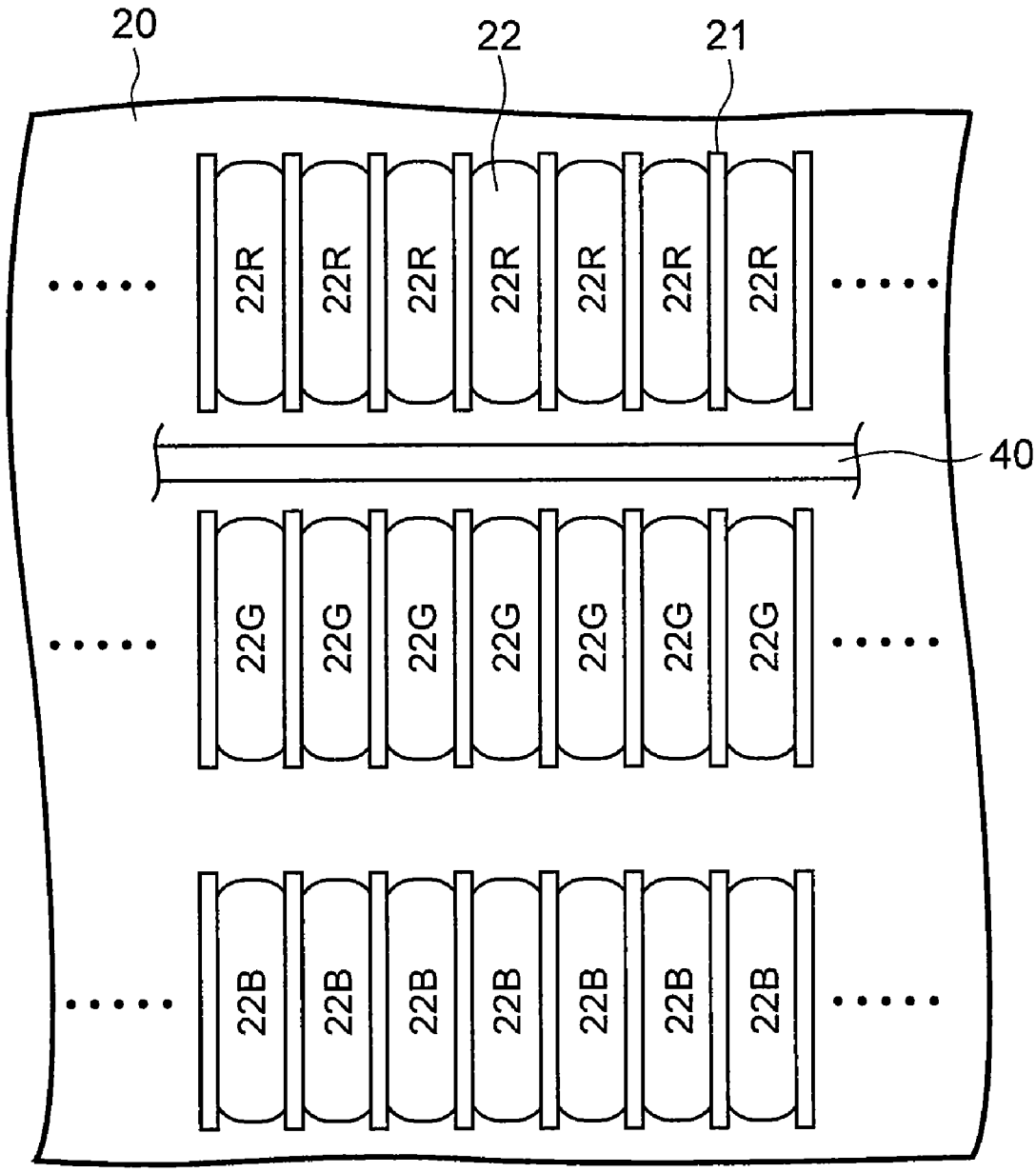
FIG. 17 is an arrangement diagram schematically showing the arrangement of partition walls, spacers and phosphor areas in an anode panel which constitutes a flat panel display.

Several examples of the state of arrangement of the partition walls 21, the spacers 40 and the phosphor areas 22 are schematically shown in FIGS. 12 to 17. The arrangement of the phosphor areas and others in the display shown in each of FIGS. 1, 3 to 5 and 7 to 11 is as shown in FIG. 13 or 15. In FIGS. 12 to 17, the illustration of the anode electrode is omitted. The planar shapes of the respective partition walls 21 may be grate-like shapes (a parallel-cross shape), that is to say, shapes each surrounding the four sides of a respective one of the phosphor areas 22 that corresponds to one subpixel and has, for example, an approximately rectangular plane shape (refer to FIGS. 12, 13, 14 and 15), or may also be strip-like shapes each extending in parallel with two facing sides of a respective one of the phosphor areas 22 that has an approximately rectangular (or strip-like) shape (refer to FIGS. 16 and 17). In addition, regarding the phosphor areas 22 shown in FIG. 16, each of the phosphor areas 22R, 22G and 22B may also be formed in a strip-like shape extending in the vertical direction as viewed in FIG. 16. Part of the partition walls 21 function as the spacer holding sections 25 for holding the spacers 40.

Except for the formation of the partition walls 21, the anode panel AP in the second embodiment or the structure and construction of the display of the second embodiment can be made the same as the anode panel AP in the first embodiment or the structure and construction of the display of the first embodiment. Accordingly, detailed description is herein omitted.

The following description refers to an outline of the difference between a method of manufacturing the anode panel AP for the flat panel display according to the second embodiment and the manufacturing method according to the first embodiment.

[Step-A-200]

First, the grate-shaped partition walls 21 are formed on the substrate 20. Specifically, after a lead glass layer colored in black by a metallic oxide such as cobalt oxide has been formed to a thickness of approximately 50 μm, the lead glass layer is selectively processed by a photolithography technique and an etching technique, to form the partition walls 21 in a double-cross shape. In addition, as occasion demands, the partition walls 21 may be formed by printing a low-melting glass paste on the substrate 20 by a screen printing method and firing the low-melting glass paste. Otherwise, the partition walls 21 may be formed by forming a photosensitive polyimide resin on the entire surface of the substrate 20 and performing exposure and development of the photosensitive polyimide resin. The dimensions of the opening area of each of the partition walls 21 were made approximately 280 μm long×100 μm wide×60 μm high. In addition, before the formation of the partition walls 21, the light absorption layer (the black matrix) 23 made of, for example, chromium oxide is preferably formed on the surfaces of the sections of the substrate 20 on which the respective partition walls 21 are to be formed.

[Step-A-210]

Then, the respective phosphor areas 22 are formed on the sections of the substrate 20 that are respectively surrounded by the partition walls 21, in a manner similar to [Step-A-110] performed in the first embodiment.

[Step-A-220]

Then, a resin layer is formed on the top surfaces of the respective partition walls 21 and on the phosphor areas 22. Specifically, a step which is approximately the same as [Step-A-120] performed in the first embodiment may be executed.

[Step-A-230]

Then, a conductive material layer is formed on the entire surface (specifically, on the entire surface of the resin layer) in a manner similar to [Step-A-130] performed in the first embodiment.

[Step-A-240]

Then, the resin layer is removed by heat treatment in a manner similar to [Step-A-140] performed in the first embodiment.

[Step-A-250]

Then, the anode electrode peripheral section 24B is formed in a manner similar to [Step-A-150] performed in the first embodiment. In addition, the anode electrode peripheral section 24B may be first formed and then the anode electrode central section 24A may be formed. Otherwise, the lower layer section of the anode electrode central section 24A and the anode electrode peripheral section 24B may be first formed at the same time and then the upper layer section of the anode electrode central section 24A may be formed.

[Step-A-160]

Then, assembling of the display is carried out in a manner similar to [Step-A-160] performed in the first embodiment.

Embodiment 3

The third embodiment is described below.

Figure 4:
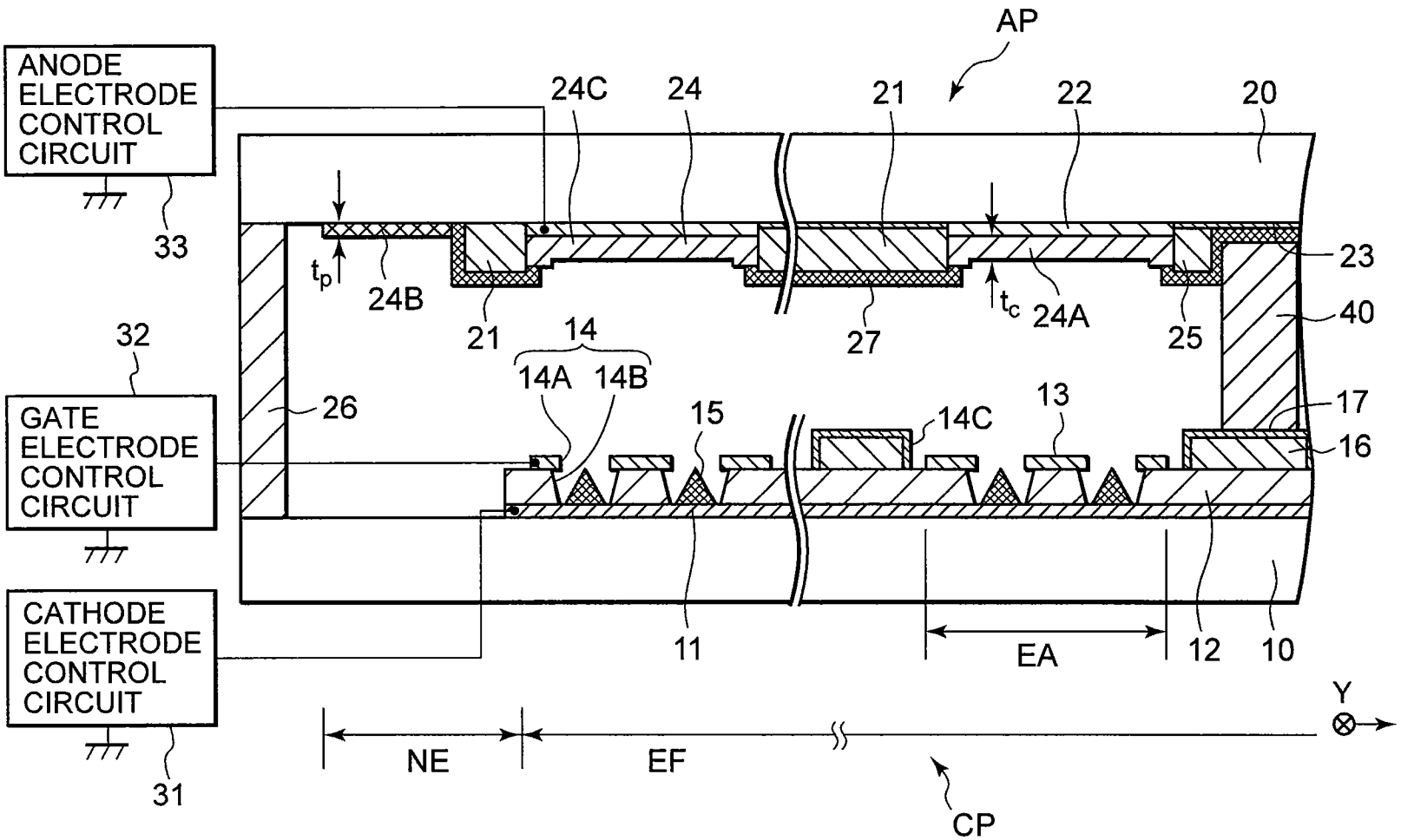
FIG. 4 is a schematic end view, in fragmentary cross section, of a display according to a third embodiment provided with Spindt-type cold cathode field emitters.

The third embodiment is a modification of the second embodiment. In the second embodiment, the anode electrode central section 24A is formed on the top surfaces of the partition walls 21. As shown in FIG. 4 which is a schematic end view, in fragmentary cross section, of the display according to the third embodiment, in the third embodiment, the anode electrode central section 24A is formed to cover each of the phosphor areas 22 and extends to the side surfaces of each adjacent one of the partition walls 21, but is not formed on the top surfaces of the partition walls 21. Namely, the anode electrode 24 is made of a plurality of anode electrode units 24C (more specifically, corresponding to subpixels, respectively). Adjacent ones of the anode electrode units 24C are electrically connected to each other by an anode electrode resistor layer 27.

Except for the fact that the partition walls 21 are formed in the above-mentioned manner and the anode electrode 24 is made of the plurality of anode electrode units 24C, the anode panel AP in the third embodiment or the structure and construction of the display of the third embodiment can be made the same as the anode panel AP in the first embodiment or the structure and construction of the display of the first embodiment. Accordingly, detailed description is herein omitted.

During the fabrication of the anode panel AP in the third embodiment, the sections of the anode electrode central section 24A that are respectively located on the top surfaces of the partition walls 21 are removed by an appropriate method (for example, an etching method) between [Step-A-240] and [Step-A-250] of the second embodiment, or in [Step-A-230] of the second embodiment, the conductive material layer is formed not on the entire surface but on each of the phosphor areas 22 (or on each of the phosphor areas 22 and on the side surfaces of the partition walls 21 adjacent to each of the phosphor areas 22). Then, the anode electrode resistor layer 27 that electrically connects adjacent ones of the anode electrode units 24C is formed to extend from the top surface to the side surfaces of each of the partition walls 21, so that the anode panel AP is fabricated. In addition, the anode electrode resistor layer 27 may be first formed and then the anode electrode units 24C may be formed.

Embodiment 4

The fourth embodiment is described below.

The fourth embodiment relates to a flat panel display according to the second and fourth aspects, a method of manufacturing an anode panel for the flat panel display according to the second aspect, and a method of manufacturing a cathode panel for the flat panel display according to the second aspect.

Figure 5:
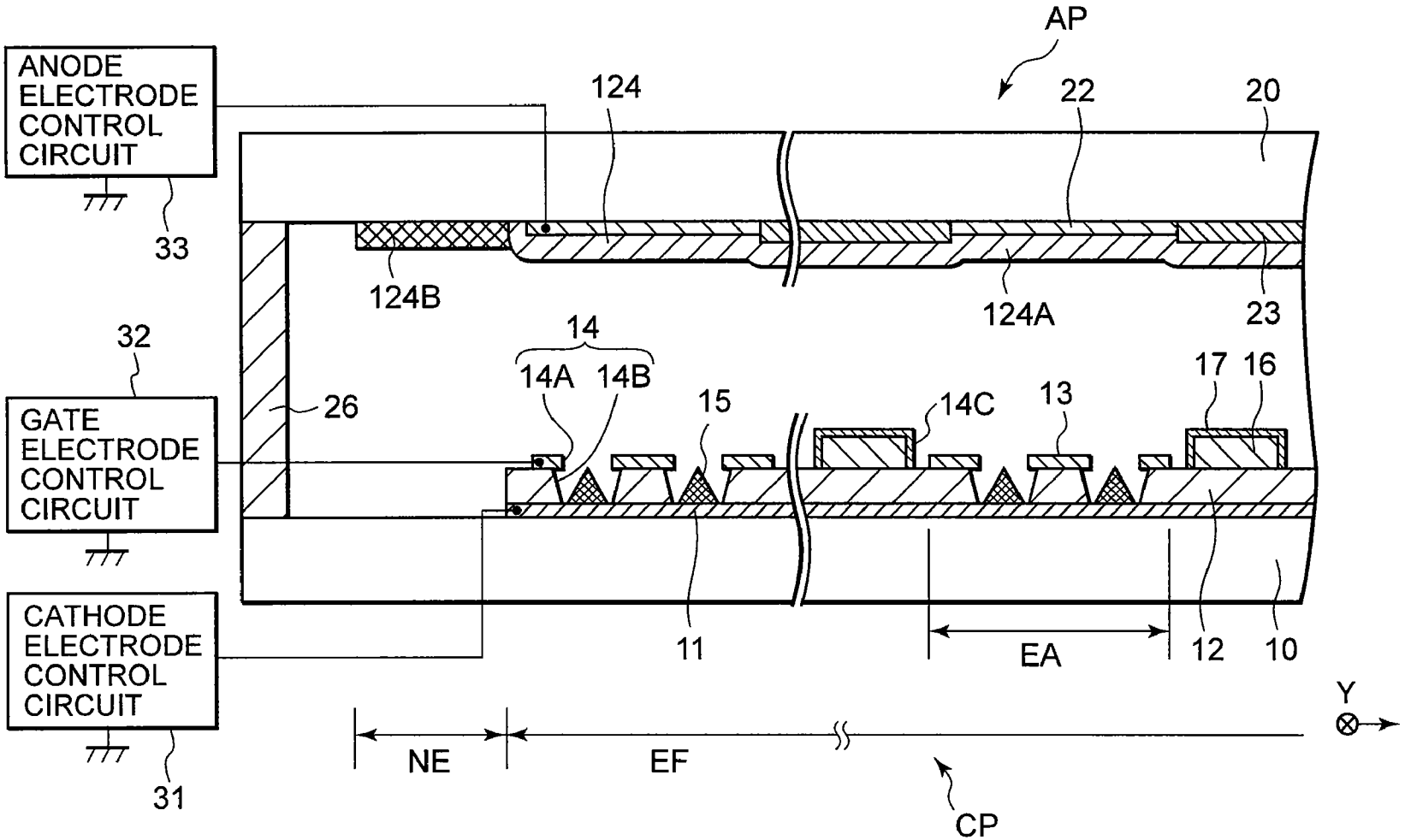
FIG. 5 is a schematic end view, in fragmentary cross section, of a display according to a fourth embodiment provided with Spindt-type cold cathode field emitters.
Figure 6A:
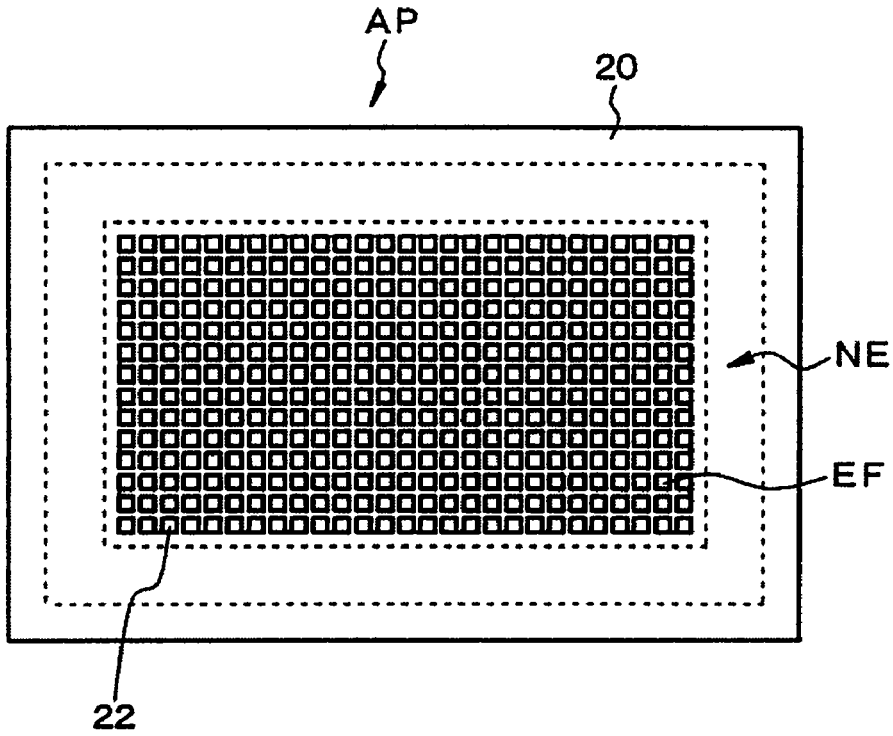
FIGS. 6A and 6B are conceptual diagrams showing the state of arrangement of constituent elements of an anode panel in the display according to the fourth embodiment.
Figure 6B:
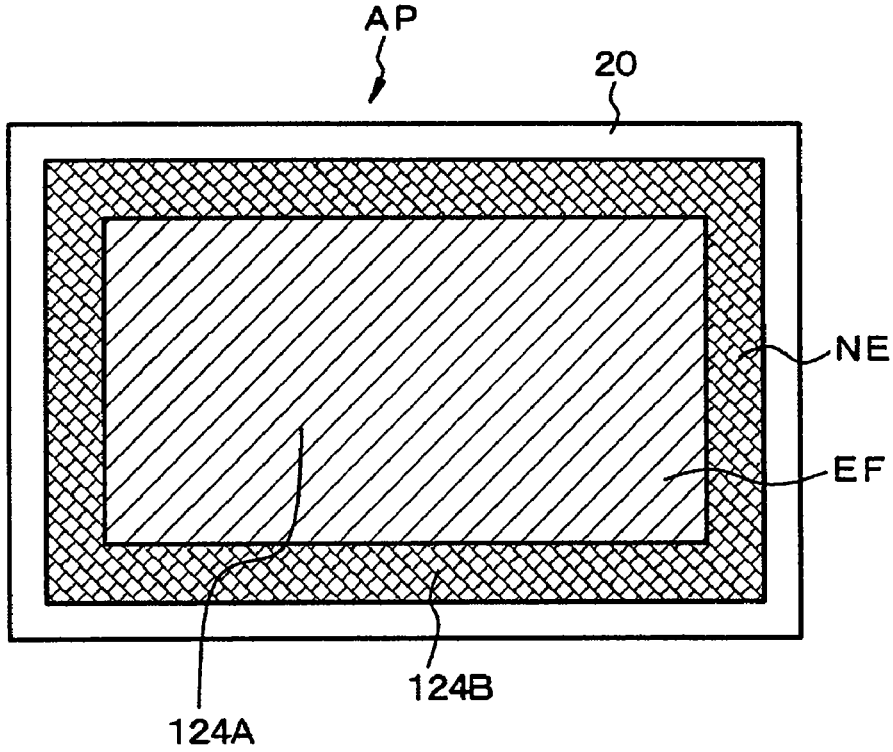

FIG. 5 shows a schematic end view, in fragmentary cross section, of the display according to the fourth embodiment, and FIGS. 6A and 6B show conceptual diagrams showing the state of arrangement of constituent elements of the anode panel in the display according to the fourth embodiment.

In the fourth embodiment, the anode electrode 124 includes the anode electrode central section 124A which covers the phosphor areas 22, and an anode electrode peripheral section 124B which surrounds the anode electrode central section 124A and is provided in contact with the substrate 20. The anode electrode central section 124A is formed on the section of the substrate 20 that constitutes the effective area EF, and the anode electrode peripheral section 124B is formed on the section of the substrate 20 that constitutes the ineffective area NE. The anode electrode central section 24A is made of a first conductive material (specifically, aluminum of thickness 0.3 μm), and the anode electrode peripheral section 24B is made of a second conductive material different from the first conductive material (specifically, carbon of thickness 0.2 μm). In addition, the anode electrode central section 124A may be made of an aluminum alloy similar to that used in the first embodiment.

The section of each of the electron emission areas EA that is opposed to the anode panel AP is defined by the focusing electrode 17, and the focusing electrode 17 is made of aluminum alloy of thickness 0.4 μm (for example, Al—Cr alloy (Cr content: 20 weight %)) similarly to the focusing electrode 17 used in the first embodiment, and serves to restrain occurrence of whiskers and/or hillocks which may cause discharge from the focusing electrode 17. The electron emission areas EA are similarly constructed in each of the fifth and sixth embodiments as well.

A method of manufacturing the display according to the fourth embodiment will be described below. Since the cathode panel CP may be fabricated in a similar manner mentioned above in connection with the first embodiment, the description of a method of manufacturing the cathode panel CP is omitted, and a method of manufacturing the anode panel AP is described below.

[Step-A-400]

First, for example, the light absorption layer (black matrix) 23 made from a grating of chromium oxide is formed on the substrate 20.

[Step-A-410]

Then, the phosphor areas 22 are formed on the exposed surface sections of the substrate 20 each of which is surrounded by the light absorption layer 23, in a manner similar to [Step-A-110] performed in the first embodiment

[Step-A-420]

After that, a resin layer is formed on the entire surface in a manner similar to [Step-A-120] performed in the first embodiment.

After the phosphor areas 22 have been formed on the substrate 20 in the above-mentioned manner, the anode electrode 124 which includes the anode electrode central section 124A covering the phosphor areas 22 and the anode electrode peripheral section 124B surrounding the anode electrode central section 124A is formed on the basis of a method which is described below.

[Step-A-430]

Namely, then, a conductive material layer is formed in the effective area EF in a manner similar to [Step-A-130] performed in the first embodiment. Specifically, a conductive material layer made of, for example, aluminum (Al) is formed so as to cover the resin layer by a vacuum evaporation method or a sputtering method by means of a mask having a pattern corresponding to the anode electrode central section 124A. Thus, the anode electrode central section 124A is obtained.

[Step-A-440]

Then, the resin layer is removed by heat treatment in a manner similar to [Step-A-140] performed in the first embodiment.

[Step-A-450]

After that, the anode electrode peripheral section 124B is formed in the ineffective area NE. Specifically, the anode electrode peripheral section 124B made of, for example, carbon is formed on the substrate 20 by a vacuum evaporation method or a sputtering method by means of a mask having a pattern corresponding to the anode electrode peripheral section 124B.

The anode panel AP can be completed by the above-mentioned steps.

In addition, the anode electrode peripheral section 124B may be first formed and then the anode electrode central section 124A may be formed.

[Step-A-460]

Then, assembling of the display is carried out in a manner similar to [Step-A-160] performed in the first embodiment.

In the fourth embodiment, the anode electrode 124 is made of the anode electrode central section 124A made of aluminum and the anode electrode peripheral section 124B made of carbon, so that when the adhesive layer is fired at approximately 400° C. for 10 to 30 minutes in [Step-A-460], a kind of projection such as whiskers or hillocks is not formed in the anode electrode peripheral section 124B.

For comparison, a display was fabricated in which the anode electrode 124 was made of an anode electrode central section and an anode electrode peripheral section each made of aluminum (Al). During the fabrication of the comparative display, when the adhesive layer was fired at approximately 400° C. for 10 to 30 minutes in [Step-A-460], a large number of projections such as whiskers or hillocks were formed in the anode electrode peripheral section.

Figure 7:
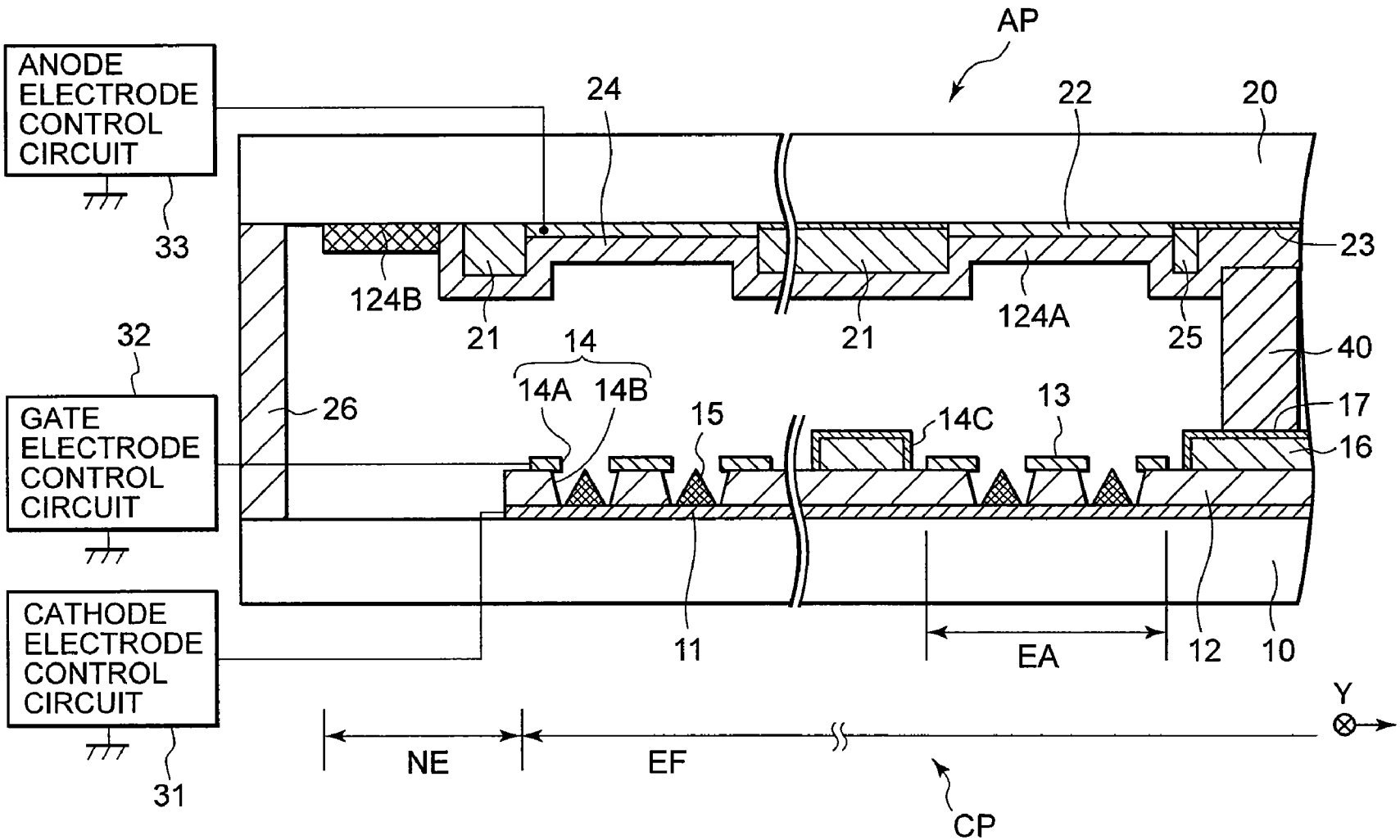
FIG. 7 is a schematic end view, in fragmentary cross section, of a modification of the display according to the fourth embodiment provided with Spindt-type cold cathode field emitters.
Figure 8:
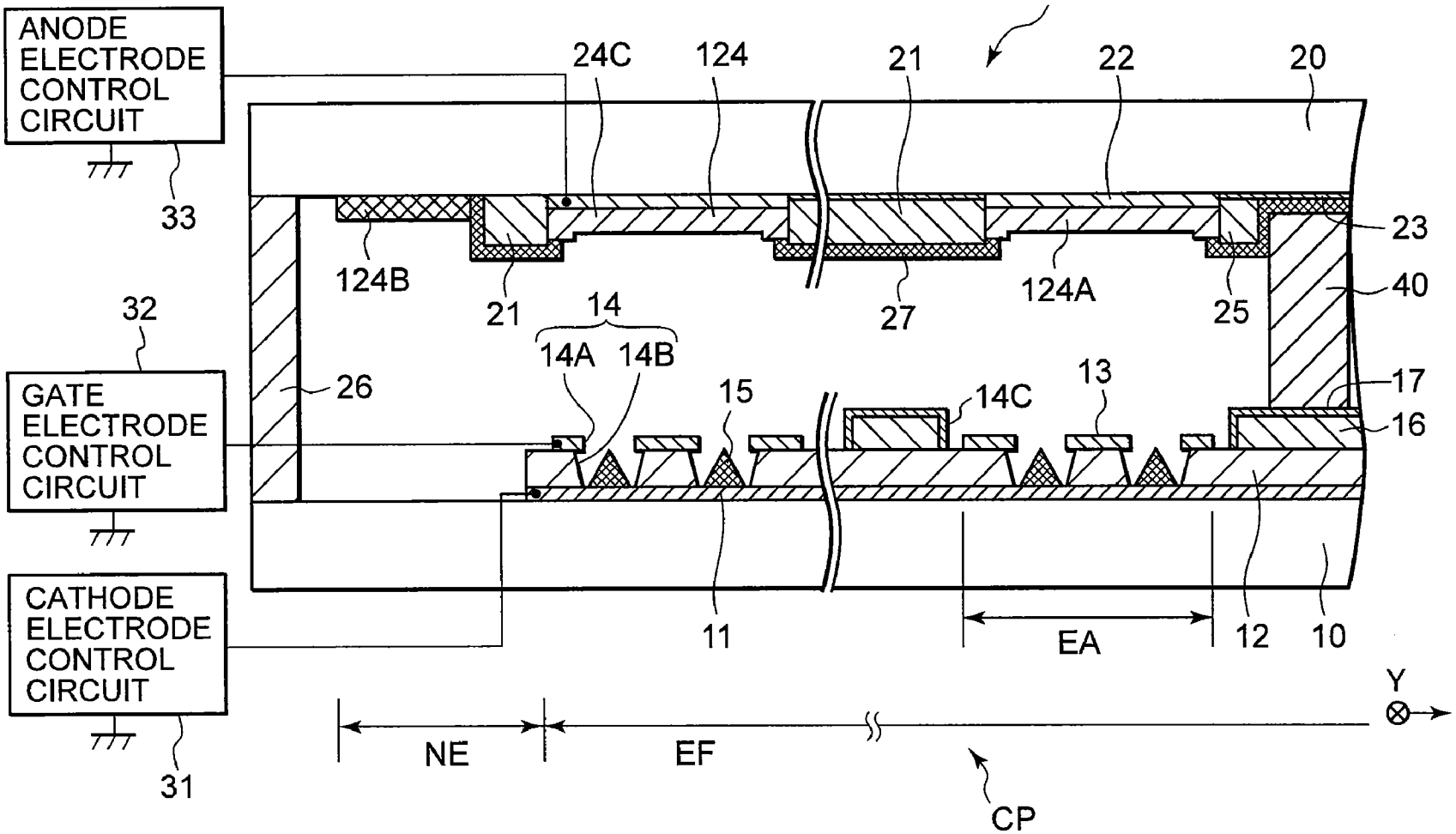
FIG. 8 is a schematic end view, in fragmentary cross section, of another modification of the display according to the fourth embodiment provided with Spindt-type cold cathode field emitters.

In addition, the structure of the anode panel AP in the fourth embodiment may be replaced with the structure of the anode panel AP mentioned above in connection with the second embodiment or the third embodiment. FIGS. 7 and 8 show schematic end views, in fragmentary cross section, of displays each having the anode panel AP having the above-mentioned construction.

Embodiment 5

The fifth embodiment of the present invention will be described below.

The fifth embodiment relates to a flat panel display according to the third and fourth aspects of the present invention, a method of manufacturing an anode panel for the flat panel display according to the third aspect of the present invention, and a method of manufacturing a cathode panel for the flat panel display according to the second aspect of the present invention.

Figure 9:
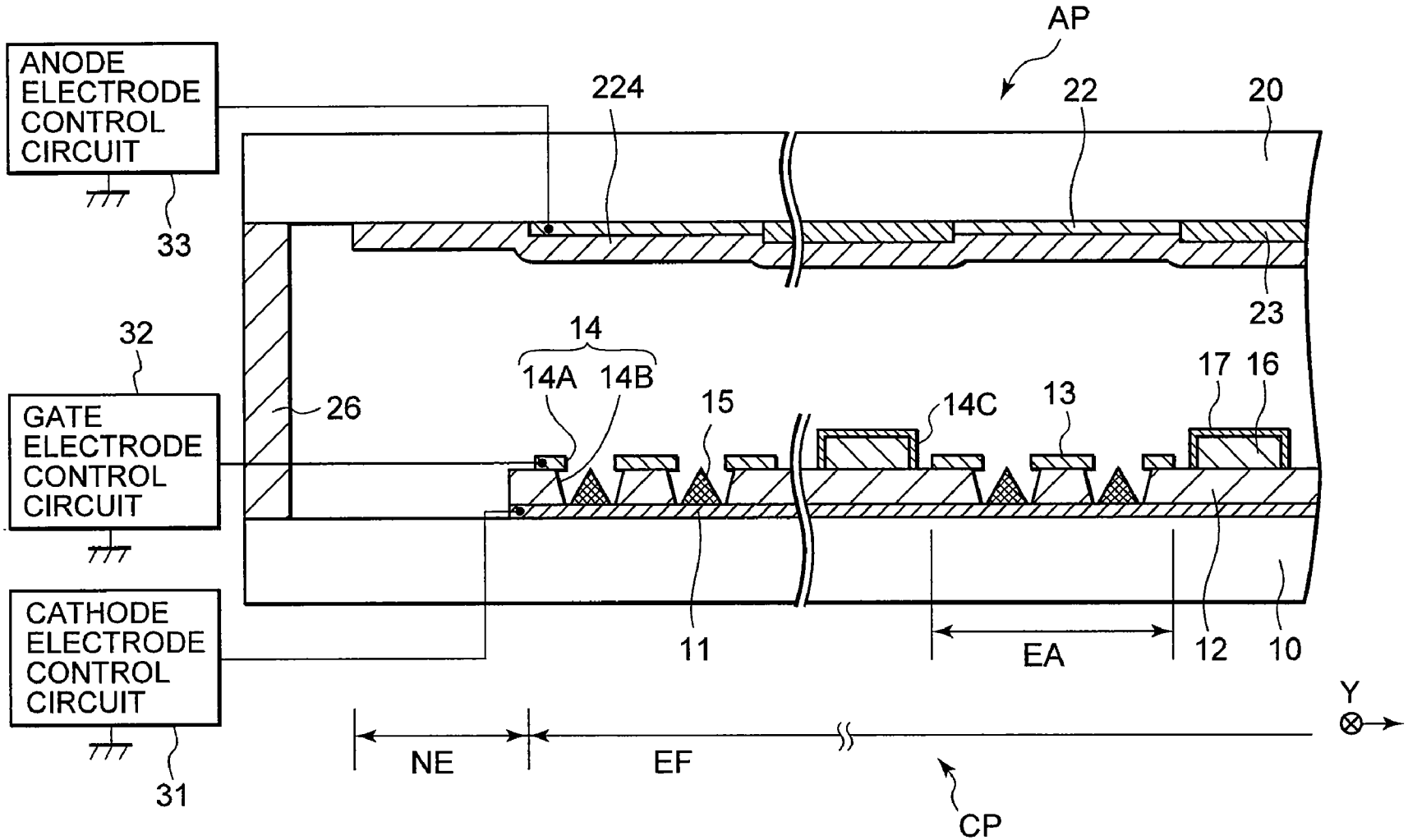
FIG. 9 is a schematic end view, in fragmentary cross section, of a display according to a fifth embodiment provided with Spindt-type cold cathode field emitters.

FIG. 9 shows a schematic end view, in fragmentary cross section, of the display according to the fourth embodiment.

In the fifth embodiment, the anode electrode 224 is made of aluminum alloy (for example, Al—Cr alloy (Cr content: 20 weight %)), and serves to restrain occurrence of whiskers and/or hillocks which may cause discharge from the focusing electrode 17.

A method of manufacturing the display according to the fifth embodiment will be described below. Since the cathode panel CP may be fabricated in a similar manner mentioned above in connection with the first embodiment, the description of a method of manufacturing the cathode panel CP is omitted, and a method of manufacturing the anode panel AP is described below.

[Step-A-500]

First, for example, the light absorption layer (black matrix) 23 made from a grating of chromium oxide is formed on the substrate 20.

[Step-A-510]

Then, the phosphor areas 22 are formed on the exposed surface sections of the substrate 20 each of which is surrounded by the light absorption layer 23, in a manner similar to [Step-A-110] performed in the first embodiment.

[Step-A-520]

After that, a resin layer is formed on the entire surface in a manner similar to [Step-A-120] performed in the first embodiment.

[Step-A-530]

After that, an aluminum layer is formed in the effective area EF (or may also be extended into the ineffective area NE as occasion demands). Specifically, an aluminum (Al) layer is formed to cover the resin layer, by a vacuum evaporation method or a sputtering method by means of a mask having a pattern corresponding to the anode electrode 224. The thickness of the aluminum layer is 0.3 μm.

[Step-A-540]

Then, an alloying layer (an alloying acceleration layer) made of Cr of thickness 20 nm is deposited on the aluminum layer by a sputtering method.

[Step-A-550]

Then, the resin layer is removed by heat treatment. At this time, since the aluminum layer and the alloying layer are also heated, the aluminum layer and the alloying layer react with each other, so that the anode electrode 224 made of aluminum alloy (Al—Cr alloy) can be obtained.

The anode panel AP can be completed by the above-mentioned steps.

[Step-A-560]

Then, assembling of the display is carried out in a manner similar to [Step-A-160] performed in the first embodiment.

In the fifth embodiment, since the anode electrode 224 is made of aluminum alloy which differs from aluminum in coefficient of thermal expansion, when the adhesive layer is fired at approximately 400° C. for 10 to 30 minutes in a manner similar to [Step-A-160] performed in the first embodiment, the thermal stress between the anode electrode 224 and the substrate 20 which serves as the base of the anode electrode 224 can be lowered and the difference in thermal expansion between the anode electrode 224 and the substrate 20 can be lowered. Accordingly, compressive stresses due to the difference in thermal expansion can be lowered, so that a kind of projection such as whiskers or hillocks does not occur in the anode electrode 224.

For comparison, a display was fabricated in which the anode electrode 224 was made of aluminum (Al) of thickness 0.3 μm. During the fabrication of the comparative display, when the adhesive layer was fired at approximately 400° C. for 10 to 30 minutes in [Step-A-560], a kind of projection such as whiskers or hillocks were formed in the anode electrode peripheral section (the section of the anode electrode 224 that was formed on the ineffective area NE).

Figure 10:
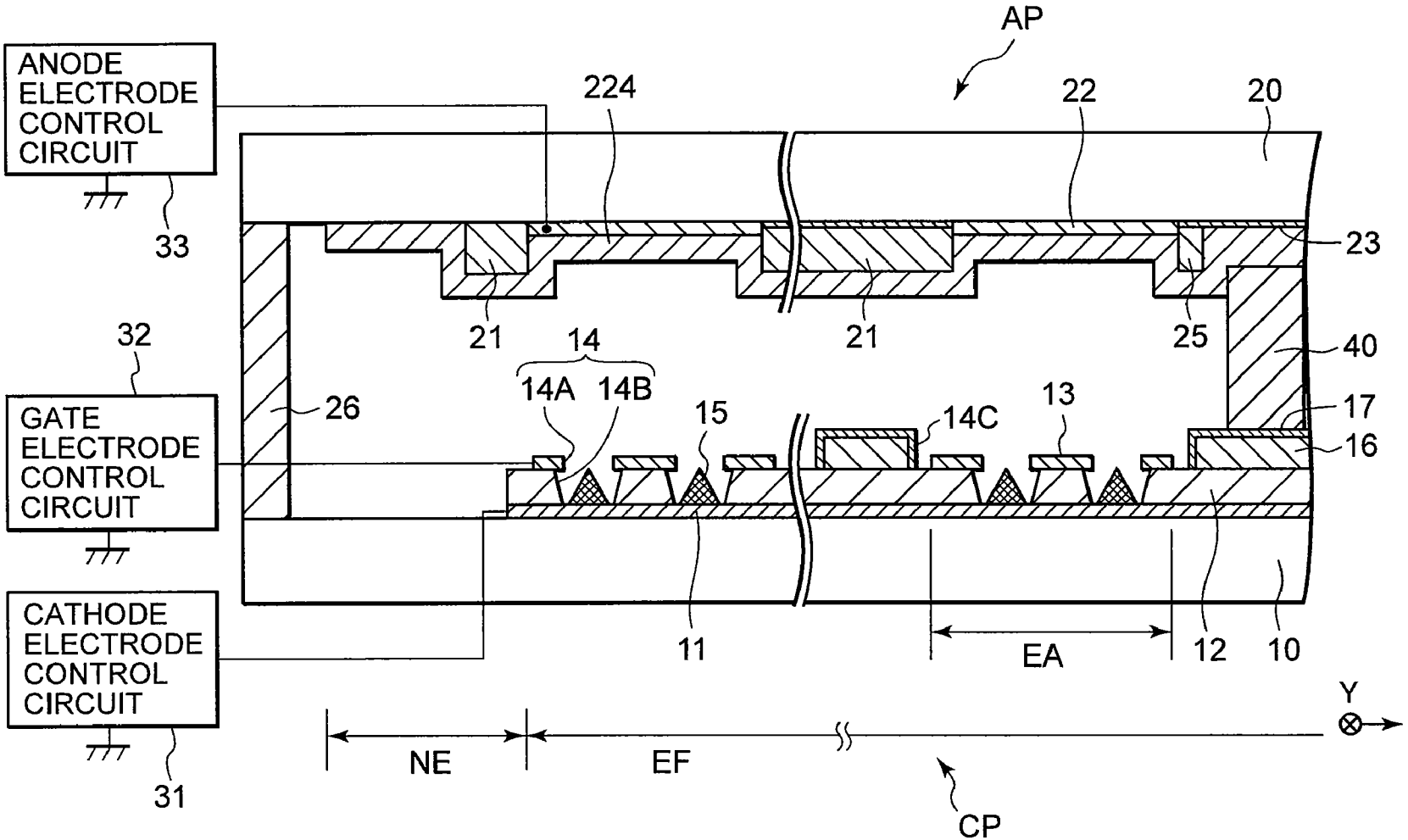
FIG. 10 is a schematic end view, in fragmentary cross section, of a modification of the display according to the fifth embodiment provided with Spindt-type cold cathode field emitters.
Figure 11:
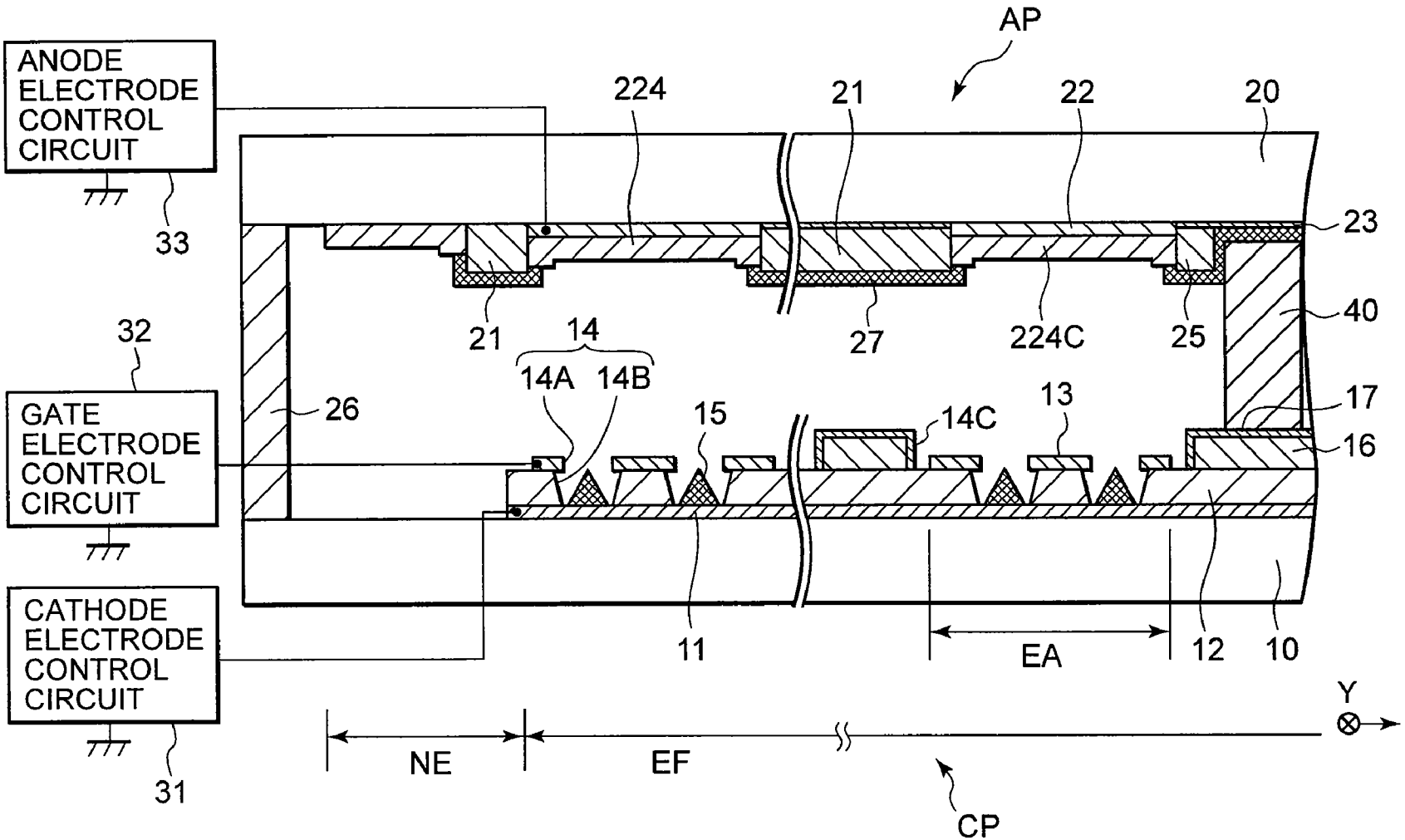
FIG. 11 is a schematic end view, in fragmentary cross section, of another modification of the display according to the fifth embodiment provided with Spindt-type cold cathode field emitters.
Figure 12:
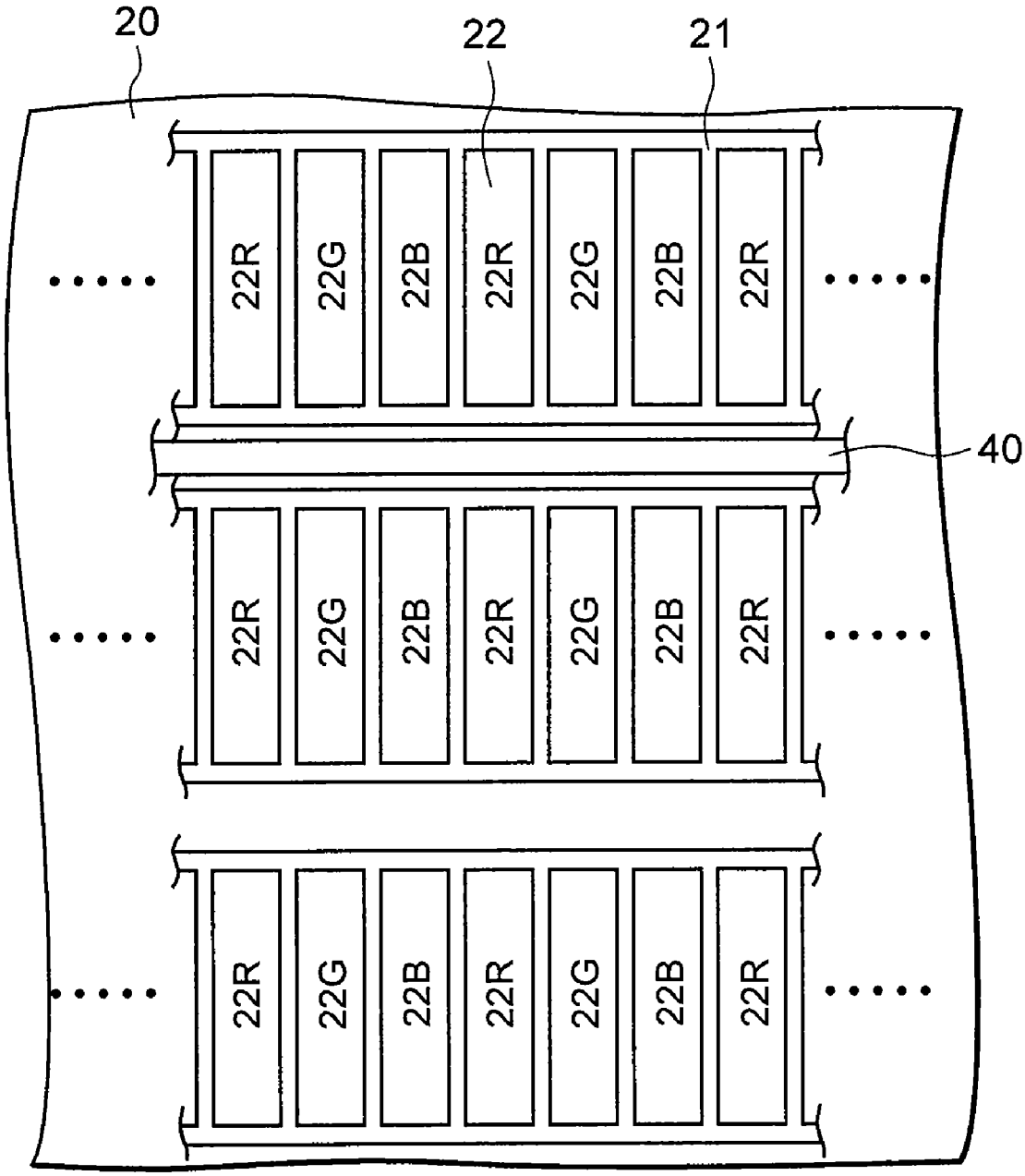
FIG. 12 is an arrangement diagram schematically showing the arrangement of partition walls, spacers and phosphor areas in an anode panel which constitutes a flat panel display.

In addition, the structure of the anode panel AP in the fifth embodiment or in the sixth embodiment which is described later may be replaced with the structure of the anode panel AP mentioned above in connection with the second embodiment or the third embodiment. FIGS. 10 and 11 show schematic end views, in fragmentary cross section, of displays each have the anode electrode AP having the above-mentioned construction.

After [Step-A-520], after a reflecting layer of thickness 20 nm which is made of aluminum covering the phosphor areas 22 has been formed on the basis of a PVD method such as a vacuum evaporation method or a sputtering method, an alloying blocking layer made of $SiO_2$ of thickness 10 nm or less may be formed on the reflecting layer on the basis of a sputtering method, and then, the steps following [Step-A-530] may be executed. The thickness of the aluminum layer formed in [Step-A-530] is 0.1 μm, and the thickness of the alloying layer made of Cr formed in [Step-A-540] is 20 nm. Accordingly, a stacked structure which is formed by the reflecting layer made of aluminum, the alloying blocking layer and the anode electrode 224 made of aluminum alloy can be finally obtained over the phosphor areas 22, so that light emitted from each of the phosphor areas 22 toward the anode electrode 224 can be positively reflected and emitted from the anode panel AP. Accordingly, it is possible to realize an increase in luminance of the display.

The sixth embodiment is described below.

The sixth embodiment is a modification of the fifth embodiment, and relates to a method of manufacturing an anode panel in a flat panel display according to the fourth aspect of the present invention. The display including the anode electrode 224 according to the sixth embodiment has the same construction and structure as the display including the anode electrode 224 mentioned above in connection with the fifth embodiment, and detailed description is herein omitted.

A method of manufacturing the display according to the fifth embodiment is described below. Since the cathode panel CP may be fabricated in a similar manner mentioned above in connection with the first embodiment, the description of a method of manufacturing the cathode panel CP is omitted, and a method of manufacturing the anode panel AP is described below.

[Step-A-600]

First, for example, the light absorption layer (black matrix) 23 made from a grating of chromium oxide is formed on the substrate 20.

[Step-A-610]

Then, the phosphor areas 22 are formed on the exposed surface sections of the substrate 20 each of which is surrounded by the light absorption layer 23, in a manner similar to [Step-A-110] performed in the first embodiment.

[Step-A-620]

After that, a resin layer is formed on the entire surface in a manner similar to [Step-A-120] performed in the first embodiment.

[Step-A-630]

After that, an aluminum alloy layer is formed in the effective area EF (or may also be extended into the ineffective area NE as occasion demands) in a manner similar to [Step-A-130] performed in the first embodiment. Specifically, an aluminum alloy layer (an Al—Cr layer) is formed to cover the resin layer, by a vacuum evaporation method or a sputtering method by means of a mask having a pattern corresponding to the anode electrode 224. The thickness of the aluminum layer is 0.3 μm. Thus, the anode electrode 224 made of aluminum alloy (Al—Cr alloy) can be obtained.

[Step-A-640]

Then, the resin layer is removed by heat treatment.

The anode panel AP can be completed by the above-mentioned steps.

[Step-A-650]

Then, assembling of the display is carried out in a manner similar to [Step-A-160] performed in the first embodiment.

In the sixth embodiment, since the anode electrode 224 is, as in the case of the fifth embodiment, made of aluminum alloy which differs from aluminum in coefficient of thermal expansion, when the adhesive layer is fired at approximately 400° C. for 10 to 30 minutes in a manner similar to [Step-A-160] performed in the first embodiment, the thermal stress between the anode electrode 224 and the substrate 20 which serves as the base of the anode electrode 224 can be lowered and the difference in thermal expansion between the anode electrode 224 and the substrate 20 can be lowered. Accordingly, compressive stresses due to the difference in thermal expansion can be lowered, so that a kind of projection such as whiskers or hillocks does not occur in the anode electrode 224.

A seventh embodiment is described below.

The seventh embodiment relates to a flat panel display according to the fourth aspect of the present invention as well as a method of manufacturing a cathode panel in the flat panel display according to the first aspect of the present invention. The display including the focusing electrode 17 according to the seventh embodiment has the same construction and structure as the display including the focusing electrode 17 mentioned above in connection with the first embodiment, and detailed description is herein omitted.

A method of manufacturing the display according to the seventh embodiment will be described below. Since the anode panel AP may be fabricated in a similar manner mentioned above in connection with each of the first to sixth embodiments, the description of a method of manufacturing the anode panel AP is omitted, and a method of manufacturing the cathode panel CP is described below.

[Step-C-700]

First, for example, the cathode electrode 11 of strip-like shape is formed in a manner similar to [Step-C-100] performed in the first embodiment, and the insulation layer 12 made of $SiO_2$ is formed on the entire surface by a CVD method.

[Step-C-710]

Then, the gate electrode 13 of strip-like shape is formed on the insulation layer 12 in a manner similar to [Step-C-110] performed in the first embodiment.

[Step-C-720]

Then, an aluminum (Al) layer is formed, and after an alloying layer has been formed on the aluminum layer, the aluminum layer and the alloying layer are made to react with each other by heat treatment, so that the focusing electrode 17 made of aluminum alloy is obtained. Specifically, for example, a photosensitive polyimide resin is formed on the entire surface of the gate electrode 13 and the insulation layer 12, and the photosensitive polyimide resin is exposed, developed and fired, thereby forming the interlayer insulation layer 16 in which the third opening section 14C is provided. After that, while the support 10 is being rotated, an aluminum layer is formed over the interlayer insulation layer 16 by an oblique vacuum evaporation method. The aluminum layer is extended to the top section of the side surface of the third opening section 14C. The thickness of the aluminum layer on the interlayer insulation layer 16 is 0.2 μm.

Then, an alloying layer made of Cr thickness 20 nm is deposited on the aluminum layer by an oblique evaporation method.

Then, the aluminum layer and the alloying layer are made to react with each other by heat treatment, so that the focusing electrode 17 made of aluminum alloy is obtained. The conditions of heat treatment are a nitrogen gas atmosphere, approximately 400° C., and 10 to 30 minutes. Accordingly, it is possible to restrain occurrence of whiskers and/or hillocks which may cause discharge from the focusing electrode 17.

Then, a resist layer is provided, and the first opening section 14A is formed in the gate electrode 13 by etching, and the second opening section 14B is formed in the insulation layer 12. After the cathode electrode 11 has been exposed at the bottom of the second opening section 14B, the resist layer is removed.

[Step-C-730]

Then, the electron emission section 15 is formed in a manner similar to [Step-C-130] to [Step-C-150] performed in the first embodiment.

In this manner, the cathode panel CP in which a plurality of field emitters are formed can be obtained.

After that, the display is completed in a similar manner mentioned above in connection with each of the first to sixth embodiments.

In the seventh embodiment as well, since the focusing electrode 17 is made of aluminum alloy, when the adhesive layer is fired at approximately 400° C. for 10 to 30 minutes in a manner similar to [Step-A-160] performed in the first embodiment, the difference in thermal expansion between the focusing electrode 17 and the interlayer insulation layer 16 which serves as the base of the focusing electrode 17 can be lowered. Accordingly, compressive stresses due to the difference in thermal expansion can be lowered, so that a kind of projection such as whiskers or hillocks does not occur in the focusing electrode 17.

Although the present invention has been mentioned above with reference to the preferred embodiments, the present invention is not limited to any of the embodiments. The constructions and structures of the displays, the cathode panels, the anode panels, the cold cathode field emission displays and the cold cathode field emitters, all of which have been mentioned above in connection with the embodiments, are illustrative, and can be variously modified. The methods of manufacturing the cathode panels, the anode panels, the cold cathode field emission displays and the cold cathode field emitters are also illustrative, and can be variously modified. Furthermore, the various materials used in the manufacture of the anode panels and the cathode panels are illustrative and can be variously modified. The displays according to the respective embodiments have been mentioned as color displays by way of example, but can also be constructed as monochromic displays. As occasion demands, the formation of the focusing electrodes can be omitted.

The above-mentioned field emitters have a form in which one electron emission section corresponds to one opening section, but the field emitters may also have a structure in which a plurality of electron emission sections correspond to one opening section or one electron emission section corresponds to a plurality of opening sections. Otherwise, a plurality of first opening sections may be provided in the gate electrode and a second opening section which communicates with the plurality of first opening sections may be provided in the insulation layer so that one or a plurality of electron emission section are provided.

The electron emission areas can also be constructed from electron emitters called surface-conduction electron emitters. A surface-conduction electron emitter includes a support made of, for example, glass, and a conductive material formed on the support, such as tin oxide ($SnO_2$), gold (Au), indium oxide ($In_2O_3$)/tin oxide ($SnO_2$), carbon, or palladium oxide (PdO). The surface-conduction electron emitter has a pair of electrodes each of which has a minute area and is spaced apart from the other by a predetermined distance (gap), and a plurality of such pairs of electrodes are arranged in a matrix form. A carbon thin film is formed on each of the pair of electrodes. The surface-conduction electron emitter has a construction in which a row line is connected to one of the pair of electrodes, while a column line is connected to the other of the pair of electrodes. When a voltage is applied across the pair of electrodes, electric fields are applied to the carbon thin films opposed to each other across the gap, so that electrons are emitted from the carbon thin films. When the electrons are made to collide with each corresponding one of phosphor areas on the anode panel, the phosphor areas are excited to emit light, thereby obtaining a desired image. Otherwise, the electron emission areas can also be constructed from a metal/insulator/metal type of device.

It should be understood by those skilled in the art that various modifications, combinations, sub-combinations and alterations may occur depending on design requirements and other factors insofar as they are within the scope of the appended claims or the equivalents thereof.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A method of manufacturing an anode panel for a cold cathode field emission display which includes a cathode panel in which a plurality of electron emission areas are provided on a support, and an anode panel in which a plurality of phosphor areas and an anode electrode are provided on a substrate, said cathode panel and said anode panel being joined together at their periphery by a joining member, said method comprising:

forming said phosphor areas on said substrate;

forming an anode electrode which includes an anode electrode central section covering said phosphor areas and an anode electrode peripheral section surrounding said anode electrode central section and extending from said anode electrode central section, an average thickness of said anode electrode peripheral section being less than an average thickness of said anode electrode central section to reduce a compressive stress due to a difference in thermal expansion between the anode electrode peripheral section and the substrate during heating; and joining the anode panel to the cathode panel by the joining member while heating at a temperature of about 400° C., wherein the reduction in compressive stress between the anode electrode peripheral section and the substrate reduces the occurrence of whiskers or hillocks on the anode electrode peripheral portion.

2. The method of manufacturing said anode panel according to claim 1, wherein said anode panel comprises aluminum or an aluminum alloy and is formed by a physical vapor deposition method.

3. The method of manufacturing said anode panel according to claim 1, wherein $0.1 \leqq t_P/t_C \leqq 0.5$ is satisfied, where $t_P$ denotes said average thickness of said anode electrode peripheral section and $t_C$ denotes said average thickness of said anode electrode central section.

* * * * *